US009510126B2

(12) United States Patent
Takahashi et al.

(10) Patent No.: US 9,510,126 B2
(45) Date of Patent: Nov. 29, 2016

(54) SOUND FIELD CONTROL DEVICE, SOUND FIELD CONTROL METHOD, PROGRAM, SOUND CONTROL SYSTEM AND SERVER

(71) Applicant: SONY CORPORATION, Tokyo (JP)

(72) Inventors: Naoya Takahashi, Tokyo (JP); Masayuki Nishiguchi, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 45 days.

(21) Appl. No.: 14/359,208

(22) PCT Filed: Dec. 20, 2012

(86) PCT No.: PCT/JP2012/083078

§ 371 (c)(1),
(2) Date: May 19, 2014

(87) PCT Pub. No.: WO2013/105413

PCT Pub. Date: Jul. 18, 2013

(65) Prior Publication Data

US 2014/0321680 A1 Oct. 30, 2014

(30) Foreign Application Priority Data

Jan. 11, 2012 (JP) ..... 2012-003266
Jul. 13, 2012 (JP) ..... 2012-158022

(51) Int. Cl.
*H04R 5/02* (2006.01)
*H04S 7/00* (2006.01)

(52) U.S. Cl.
CPC ..... *H04S 7/302* (2013.01); *H04S 7/304* (2013.01); *H04S 2400/01* (2013.01); *H04S 2400/11* (2013.01); *H04S 2400/13* (2013.01)

(58) Field of Classification Search
CPC ..... H04R 5/02; H04S 7/301
USPC ..... 381/303
See application file for complete search history.

(56) References Cited

U.S. PATENT DOCUMENTS 6,490,359 B1 12/2002 Gibson
2003/0091204 A1 5/2003 Gibson
(Continued)

FOREIGN PATENT DOCUMENTS

JP 9-90963 4/1997
JP 2005-49656 2/2005
JP 2005-295181 10/2005
JP 2006-94315 4/2006
JP 2007-81928 3/2007
(Continued)

OTHER PUBLICATIONS

Extended European Search Report issued Jul. 20, 2015 in Patent Application No. 12865517.2.
(Continued)

*Primary Examiner* — Simon King
(74) *Attorney, Agent, or Firm* — Oblon, McClelland, Maier & Neustadt, L.L.P.

(57) ABSTRACT

A sound field control device according to the present disclosure includes a display target object position information acquisition unit for acquiring position information of a viewer from information obtained by imaging, and a virtual sound source position control unit for controlling a virtual sound source position on the basis of the position information. Thus, it becomes possible to optimally adjust virtual sound source reproduction in consideration of size or orientation of a head. Accordingly, it becomes possible to provide a sound field without unnatural feeling to viewers.

7 Claims, 18 Drawing Sheets

(56) References Cited

U.S. PATENT DOCUMENTS

| | | | | |
|---|---|---|---|---|
| 2004/0240686 | A1 | 12/2004 | Gibson | |
| 2006/0064300 | A1 | 3/2006 | Holladay | |
| 2007/0011196 | A1 | 1/2007 | Ball et al. | |
| 2009/0252379 | A1 | 10/2009 | Kondo et al. | |
| 2010/0150355 | A1* | 6/2010 | Kon | H04S 7/304 381/17 |
| 2010/0323793 | A1 | 12/2010 | Andall | |
| 2010/0328423 | A1* | 12/2010 | Etter | H04N 7/15 348/14.16 |
| 2011/0007915 | A1* | 1/2011 | Park | H04N 5/607 381/306 |
| 2011/0235807 | A1 | 9/2011 | Hayashi et al. | |
| 2013/0121515 | A1* | 5/2013 | Hooley | H04R 1/403 381/307 |

FOREIGN PATENT DOCUMENTS

| | | |
|---|---|---|
| JP | 2007-214897 | 8/2007 |
| JP | 2010-206451 | 9/2010 |

OTHER PUBLICATIONS

International Search Report issued Jan. 29, 2013 in PCT/JP2012/083078.

Combined Chinese Office Action and Search Report issued Dec. 2, 2015 in Patent Application No. 201280066052.8 (with English language translation).

Japanese Office Action issued May 10, 2016 in Patent Application No. 2013-553232 (without English Translation).

* cited by examiner (b)

(a)

| | META DATA | TRANSMISSION BAND | LOAD ON CLIENT'S CPU |
|---|---|---|---|
| (1) | HRTF AMOUNT OF CHARACTERISTIC (AMOUNT OF CHANGE, DIFFERENCE) | SMALL | LARGE |
| (2) | HRTF | MEDIUM | MEDIUM |
| (3) | INFORMATION IN WHICH HRTF AND SOUND SOURCE INFORMATION ARE CONVOLVED | LARGE | SMALL |

SOUND FIELD CONTROL DEVICE, SOUND FIELD CONTROL METHOD, PROGRAM, SOUND CONTROL SYSTEM AND SERVER

TECHNICAL FIELD

The present disclosure relates to a sound field control device, a sound field control method, a program, a sound field control system and a server.

BACKGROUND ART

Conventionally, as described in Patent Literatures 1 to 3 listed below, for example, there has been proposed a device for correcting sound volume, delay and directional characteristics of a speaker depending on a position of a viewer and providing the viewer with optimum sound even at a position off a front position.

CITATION LIST

Patent Literature

Patent Literature 1: JP 2005-049656A
Patent Literature 2: JP 2007-214897A
Patent Literature 3: JP 2010-206451A

SUMMARY OF INVENTION

Technical Problem

In reproduction by a speaker, when a viewer auditions at a position which is off an assumed viewing position (normally, a position having an equal distance from all speakers, that is to say, a front position), balance of volume or timing of a sound arriving from each of the speakers is off, the sound quality deteriorates, or a normal position is displaced. In addition, there is a problem that virtual sound source reproduction effect is also lost if the viewer moves.

However, it is difficult for technologies described in Patent Literatures 1 to 3 to optimally adjust the virtual sound source reproduction since the technologies only assume adjustment of the sound volume, a delay amount, or the directional characteristics and give no consideration to size or orientation of a head.

In addition, if a display target object which is a sound source moves when a user plays a game on a mobile device or a tablet, there may arise a sense of discomfort between movement of the display target object and a sound that the user listens to.

Hence, it is needed to optimally adjust the virtual sound source reproduction.

Solution to Problem

According to the present disclosure, there is provided a sound field control device including a display target object position information acquisition unit for acquiring position information of a display target object corresponding to a sound source, and a virtual sound source position control unit for controlling a virtual sound source position on the basis of position information of the display target object.

Further, it is possible to further include a transmission unit for transmitting, to an external computer, at least the position information of the display target object, and a reception unit for receiving, from the external computer, a virtual sound source reproduction correction factor computed on the basis of the position information of the display target object or information generated on the basis of the virtual sound source reproduction correction factor.

Further, the transmission unit may transmit, to the external computer, sound data together with the position information of the display target object, and the reception unit may receive, from the external computer, sound data that is obtained by correcting the sound data with the virtual sound source reproduction correction factor computed on the basis of the position information of the display target object.

Further, it is possible to further include a viewer position information acquisition unit for acquiring position information of a viewer, and the virtual sound source position control unit may control the virtual sound source position on the basis of the position information of the display target object and the position information of the viewer.

Further, the viewer position information acquisition unit may acquire the position information of the viewer from information obtained by imaging.

Further, it is possible to further include a transmission unit for transmitting, to the external computer, the position information of the display target object and the position information of the viewer, and a reception unit for receiving, from the external computer, a virtual sound source reproduction correction factor computed on the basis of the position information of the display target object and the position information of the viewer or information generated on the basis of the virtual sound source reproduction correction factor.

Further, the transmission unit may transmit, to the external computer, sound data together with the position information of the display target object and the position information of the viewer, and the reception unit may receive, from the external computer, sound data which is obtained by correcting the sound data with the virtual sound source reproduction correction factor computed on the basis of the position information of the display target object and the position information of the viewer.

According to the present disclosure, there is provided a sound field control device including acquiring position information of a display target object corresponding to a sound source, and controlling a virtual sound source position on the basis of the position information of the display target object.

According to the present disclosure, there is provided a program for causing a computer to function as means for acquiring position information of a display target object corresponding to a sound source, and means for controlling a virtual sound source position on the basis of the position information of the display target object.

According to the present disclosure, there is provided a sound field control system including a client terminal including a display target object position information acquisition unit for acquiring position information of a display target object corresponding to a sound source, a transmission unit for transmitting the position information of the target object to an external computer, and a reception unit for receiving, from the external computer, a virtual sound source reproduction correction factor computed on the basis of the position information of the target object; and the external computer including a reception unit for receiving the position information of the display target object, a virtual sound source reproduction correction factor computation unit for computing the virtual sound source reproduction correction factor on the basis of the position information of the display target object, and a transmission unit for transmitting, to the client terminal, the virtual sound source reproduction correction factor or information generated on the basis of the virtual sound source reproduction correction factor.

According to the present disclosure, there is provided a server including the external computer including a reception unit for receiving, from a client terminal, position information of a display target object corresponding to a sound source, a virtual sound source reproduction correction factor computation unit for computing the virtual sound source reproduction correction factor on the basis of the position information of the display target object, and a transmission unit for transmitting, to the client terminal, the virtual sound source reproduction correction factor or information generated on the basis of the virtual sound source reproduction correction factor.

According to the present disclosure, there is provided a sound field control method including acquiring, by a client terminal, position information of a display target object corresponding to a sound source, transmitting, by the client terminal, the position information of the target object to an external computer, receiving, by the external computer, the position information of the display target object, computing, by the external computer, the virtual sound source reproduction correction factor on the basis of the position information of the display target object, and transmitting, by the external computer, to the client terminal, the virtual sound source reproduction correction factor or information generated on the basis of the virtual sound source reproduction correction factor.

According to the present disclosure, there is provided a sound field control device including a position information acquisition unit for acquiring position information of a viewer from information obtained by imaging, and a virtual sound source position control unit for controlling a virtual sound source position on the basis of the position information.

The virtual sound source position control unit may control the virtual sound source position in a manner that a normal position of a sound image is fixed irrespective of a position of the viewer.

The virtual sound source position control unit may control the virtual sound source position in a manner that a normal position of a sound image relatively moves according to a position of the viewer.

The virtual sound source position control unit may control the virtual sound source position by changing a head transfer function, on the basis of the position information.

The virtual sound source position control unit may control the virtual sound source position, on the basis of the position information, by smoothly changing a factor before a position of the viewer changes to a factor after the position of the viewer changes.

The virtual sound source position control unit may control the virtual sound source position, on the basis of the position information, when movement of the viewer exceeds a predetermined value.

It is possible to further include a control unit for controlling sound volume, a delay amount of sound, or a directional characteristic, on the basis of the position information.

It is possible to further include an imaging unit for acquiring the position information of the viewer.

It is possible to further include a posture information acquisition unit for acquiring posture information, and the virtual sound source position control unit may control the virtual sound source position, on the basis of the position information and the posture information.

The position information acquisition unit may acquire, from another device including an imaging unit for imaging the viewer, information obtained by the imaging.

According to the present disclosure, there is provided a sound field control method including acquiring position information of a viewer, and controlling a virtual sound source position on the basis of the position information.

According to the present disclosure, there is provided a program for causing a computer to function as means for acquiring position information of a viewer, and means for controlling a virtual sound source position on the basis of the position information.

According to the present disclosure, there is provided a sound field control system including an imaging device for imaging a viewer, and a sound field control device including a position information acquisition unit for acquiring position information of the viewer from information obtained from the imaging device, and a virtual sound source position control unit for controlling a virtual sound source position on the basis of the position information.

Advantageous Effects of Invention

According to the present disclosure, virtual sound source reproduction can be optimally adjusted.

DESCRIPTION OF EMBODIMENTS

Figure 1:
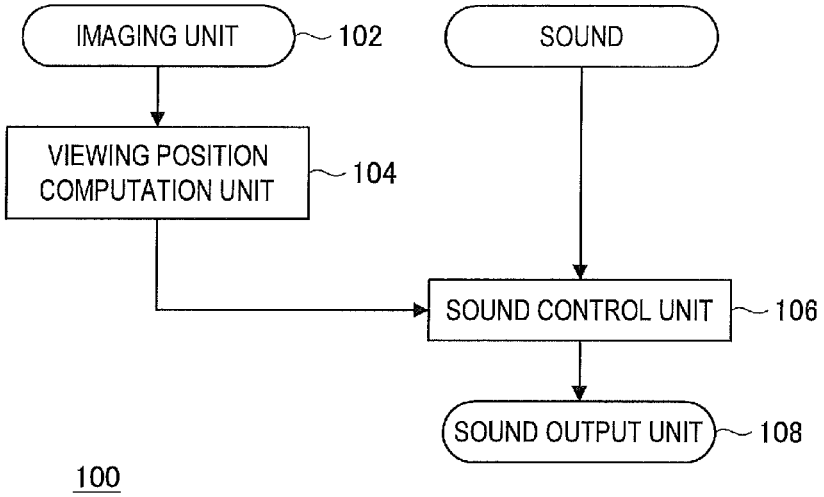
FIG. 1 is a schematic view showing a configuration example of a sound field control device according to a first embodiment of the present disclosure.

Hereinafter, preferred embodiments of the present invention will be described in detail with reference to the appended drawings. Note that, in this specification and the drawings, elements that have substantially the same function and structure are denoted with the same reference signs, and repeated explanation is omitted.

Note that a description will be given in the following order:

1. First Embodiment
   1.1. Appearance example of a sound field control device
   1.2. Configuration example of a sound field control unit
   1.3. Configuration example of a sound field adjustment processing unit
   1.4. Processing in the sound field control device
   1.5. Positional relationship between a viewer and a sound output unit
   1.6. Processing in a virtual sound source reproduction correction unit
   1.7. Processing in a sound volume correction/change unit
   1.8. Processing in a delay amount correction/change unit
   1.9. Processing in a virtual sound source reproduction correction/change unit and a directional characteristic correction/change unit
   1.10. Specific configuration example of the sound field control device
2. Second Embodiment
   2.1. Overview of a second embodiment
   2.2. Processing to be performed in a virtual sound source reproduction correction/change unit of the second embodiment
3. Third embodiment
   3.1. Overview of a third embodiment
   3.2. Configuration example of the third embodiment
4. Fourth embodiment
5. Fifth embodiment
6. Sixth embodiment
7. Seventh embodiment
8. Eighth embodiment
9. Ninth embodiment (1. First Embodiment)

[1.1. Appearance Example of a Sound Field Control Device]

FIG. 1 is a schematic view showing a configuration example of a sound field control device 100 according to a first embodiment of the present disclosure. The sound field control device 100 is provided in a television receiver, audio equipment and the like which are equipped with a speaker, and controls a sound of the speaker, depending on a position of a viewer. As shown in FIG. 1, the sound field control device 100 is configured to have an imaging unit 102, a viewing position computation unit 104, a sound control unit 106, and a sound output unit 108. The configuration shown in FIG. 1 can consist of a circuit (hardware) or a central processing unit such as a CPU and the like and a program (software) for causing the central processing unit to function, and the program can be stored in a recording medium such as a memory. This also applies to components of FIG. 3 and the like, and configurations of respective embodiments to be described below.

The imaging unit 102 images a face and a body of the viewer (user) listening to the sound. The viewing position computation unit 104 computes a position of the viewer and orientation of the face from an image obtained from the imaging unit 102. Note that the imaging unit 102 (and the viewing position computation unit 104) may be provided in a separate device from a device in which the sound field control device 100 is provided. A sound source is inputted into the sound control unit 106. The sound control unit 106 processes the sound so that good sound quality, normal position, and virtual sound source reproduction (virtual surround) effect can be obtained, depending on a position of the viewer. The sound output unit 108 is a speaker for outputting the sound controlled by the sound control unit 106.

[1.2. Configuration Example of a Sound Field Control Unit]

Figure 2:
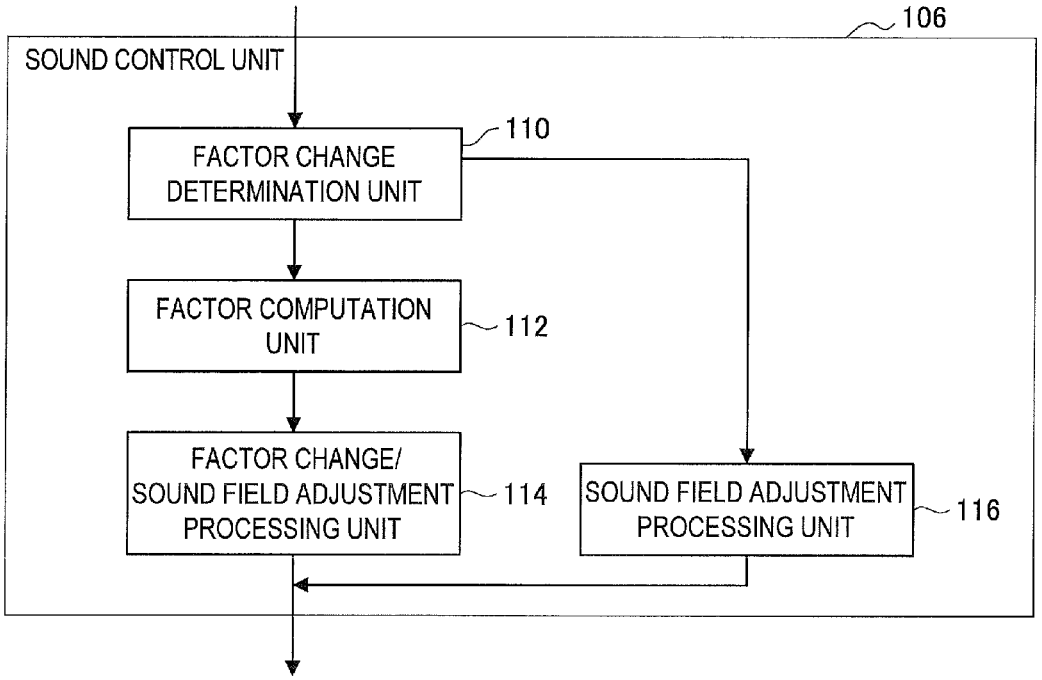
FIG. 2 is a schematic view showing a configuration of a sound control unit.

FIG. 2 is a schematic view showing a configuration of the sound control unit 106. As shown in FIG. 2, the sound control unit 106 is configured to have a factor change determination unit 110, a factor computation unit 112, a factor change/sound field adjustment processing unit 114, and a sound field adjustment processing unit 116.

The factor change determination unit 110 determines whether or not to change a factor on the basis of an image of a viewer imaged by the imaging unit 102. If the factor change determination unit 110 updates the factor every time the viewer moves only slightly or moves his or her face slightly, it is likely that a change in a tone color when a factor is updated cannot be ignored. Thus, the factor change determination unit 110 does not change a factor if motion is small. The factor change determination unit 110 makes a determination to change the factor when there is a significant (more than predetermined) change in the viewer position, which is then stabilized. In this case, the factor computation unit 112 computes an optimal sound field processing factor depending on the changed viewer position.

The factor change/sound field adjustment processing unit 114 performs sound field adjustment processing while changing the factor. The factor change/sound field adjustment processing unit 114 performs the sound field adjustment processing, while making a factor change from a factor corresponding to a previous viewer position to a factor of a current viewer position which is newly computed by the factor computation unit 112. Then, the factor change/sound field adjustment processing unit 114 smoothly changes the factor so that noise such as a sound interruption does not occur.

In addition, while the factor is being changed, the factor is not reset even if the sound control unit 106 receives a new position information computation result sent from the viewing position computation unit 104. For this reason, the factor is not changed more than is necessary, and timing of when position information is sent from the viewing position detection unit 104 does not have to be synchronous with timing of the sound processing.

On the one hand, when the viewer position does not change and if the factor change determination unit 110 determines not to change the factor, the sound field adjustment processing unit 116 performs regular sound field adjustment processing appropriate for the viewing position. The normal sound field adjustment processing corresponds to processing in step S32 in FIG. 10 to be described below.

[1.3. Configuration Example of a Sound Field Adjustment Processing Unit]

Figure 3:
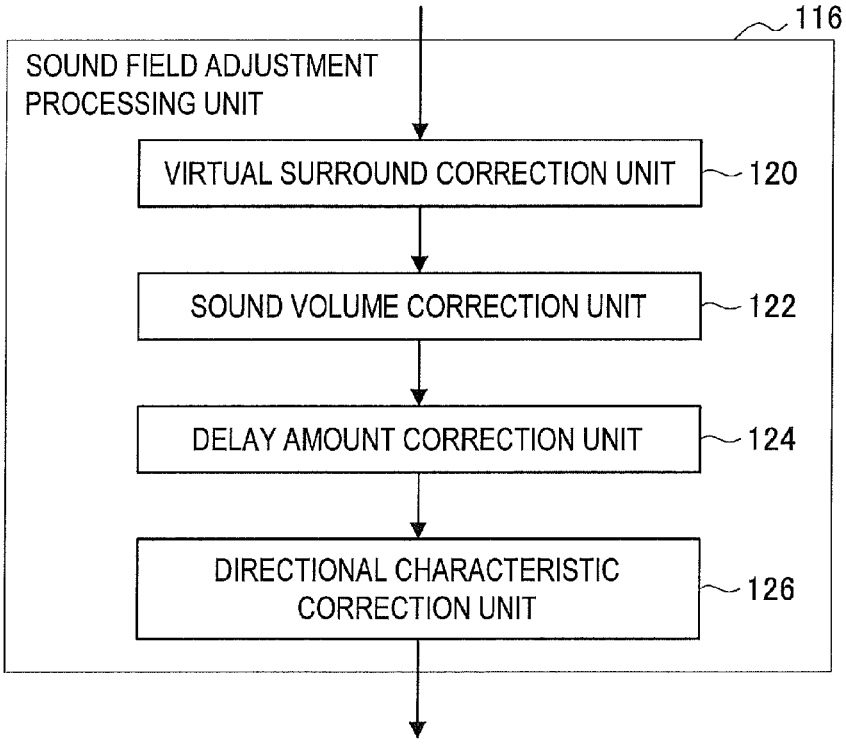
FIG. 3 is a schematic view showing a configuration of a sound field adjustment processing unit.

In the following, a configuration of the sound field adjustment processing unit 116 will be described. FIG. 3 is a schematic view showing a configuration of the sound field adjustment processing unit 116. As shown in FIG. 3, the sound field adjustment processing unit 116 is configured to have a virtual sound source reproduction correction unit 120, a sound volume correction unit 122, a delay amount correction unit 124, and a directional characteristic correction unit 126.

If a viewer position is displaced from an assumed viewing position (assumed auditioning position), the sound volume correction unit 122, the delay amount correction unit 124, and the directional characteristic correction unit 126 correct sound volume difference, arrival time difference, and a change in frequency characteristics of a sound arriving from each speaker, which are generated due to the displacement. The sound volume correction unit 122 corrects the sound volume difference, the delay amount correction unit 124 corrects the arrival time difference, and the directional characteristic correction unit 126 corrects the change in the frequency characteristics. Now, in many cases, the assumed viewing position (assumed viewing position) is a center position of right and left speakers of a television or audio system and the like, that is, a front of the television or audio system.

The sound volume correction unit 122 corrects sound volume on the basis of a viewer position acquired from the viewing position computation unit 104 so that the sound volume reaching the viewer from each speaker is equal. Sound volume A is proportional to a distance r, from each speaker to the center of a viewer's head and the following expression is true. In the following expression, $Att_i$ is a distance between the assumed auditioning position and the speaker.

$$Att_i = r_i / r_o$$

Based on the viewer position acquired from the viewing position computation unit 104, the delay amount correction unit 124 corrects a delay amount so that time to reach the viewer from each speaker is equal. The delay amount $t_i$ of each speaker is expressed by the following expression where the distance from each speaker to the center of the viewer's head is $r_i$ and the largest $r_i$ is $r_{max}$. However, c is sound velocity.

$$t_i = (r_{max} - r_i)/c$$

Based on the viewer position acquired from the viewing position computation unit 104, the directional characteristic correction unit 126 corrects the frequency characteristic of the directional characteristics of each speaker that is changed due to the displacement of the viewing position to a characteristic at the assumed viewing position. The corrected frequency characteristic $I_i$ is obtained by the following expression where the frequency characteristic of a speaker i at the assumed viewing position is $H_i$ and the frequency characteristic at the viewing position is $G_i$.

$$I_i = H_i / G_i$$

Figure 19:
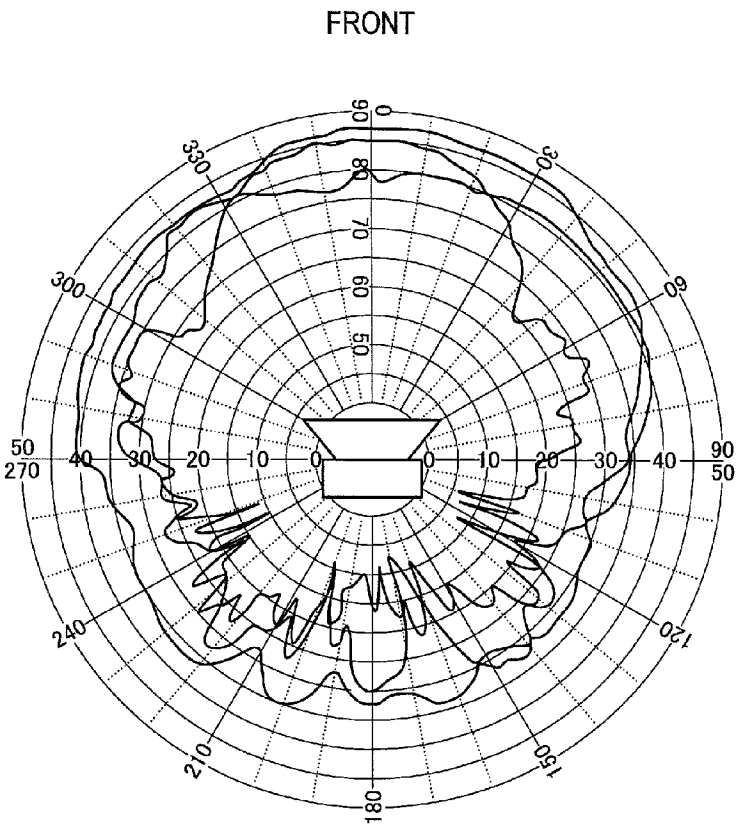
FIG. 19 is a characteristic diagram showing one example of directional characteristics of a speaker.
Figure 19:
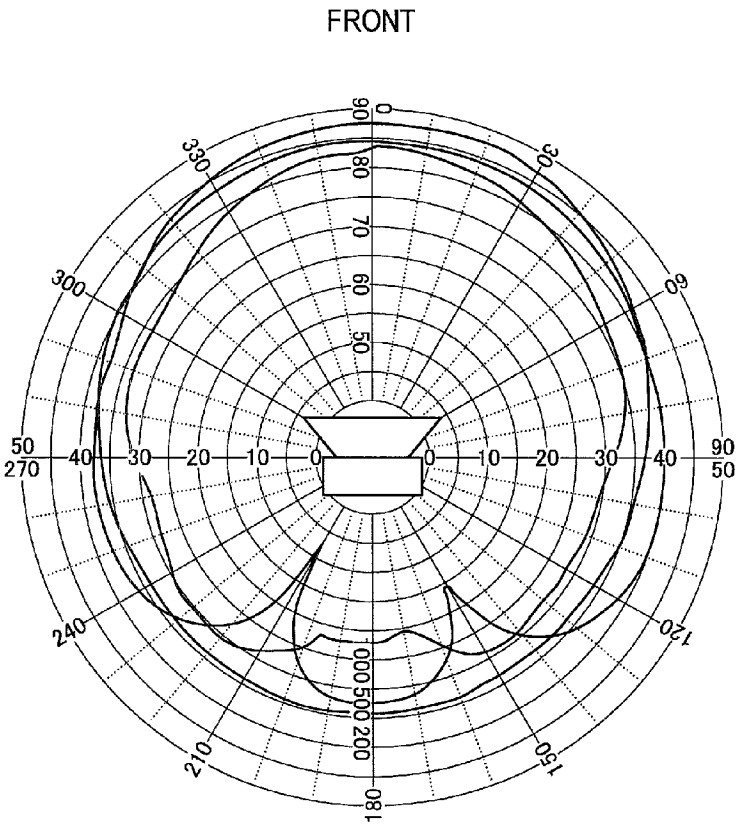

In the following, processing in the directional characteristic correction unit 126 will be described in more detail. FIG. 19 is a graph showing directional characteristics of a speaker. In each of FIG. 19(*a*) and FIG. 19(*b*), axes radially extending from the center of a circle represent sound intensity, and the sound intensity in each direction, specifically, directional characteristics, is plotted by solid lines. The upper side of the graph is the front direction (forward direction) of the speaker. The directional characteristics vary depending on a frequency of a sound to be reproduced. In FIG. 19(*a*), the directional characteristics at 200 Hz, 500 Hz, and 1,000 Hz are plotted, and the directional characteristics at 2 kHz, 5 kHz, and 10 kHz are plotted in FIG. 19(*b*), respectively.

As can be seen from FIG. 19, the sound is the most intense in the front direction of the speaker and, roughly speaking, weakens as the sound heads for a backward direction (direction 180 degrees opposite from the front). In addition, changes thereof differ depending on frequencies of a sound to be reproduced, and the sound changes a little at lower frequencies while the sound changes considerably at higher frequencies. The sound quality of the speaker is generally such adjusted that sound balance is best when the viewer listens in the front direction. It can be seen from the directional characteristics as shown in FIG. 19 that when a listener position is widely off from the front direction of the speaker, the frequency characteristic of a sound to be listened significantly changes from an ideal state and the sound balance becomes worse. A similar problem also occurs in phase characteristics of a sound.

Thus, the directional characteristics of the speaker are measured, an equalizer which may correct any effect of the directional characteristics is computed in advance, and equalizer processing is performed depending on detected direction information θh, θv, that is, orientation of the speaker main body to the listener. This enables implementation of well-balanced reproduction that does not rely on the orientation of the speaker to the listener.

As an example of a correction filter, a correction filter S can be obtained by the following expression where a frequency characteristic at an ideal viewing position is $H_{ideal}$ and a characteristic at a position away therefrom is H.

$$S = H_{ideal} / H$$

Figure 4:
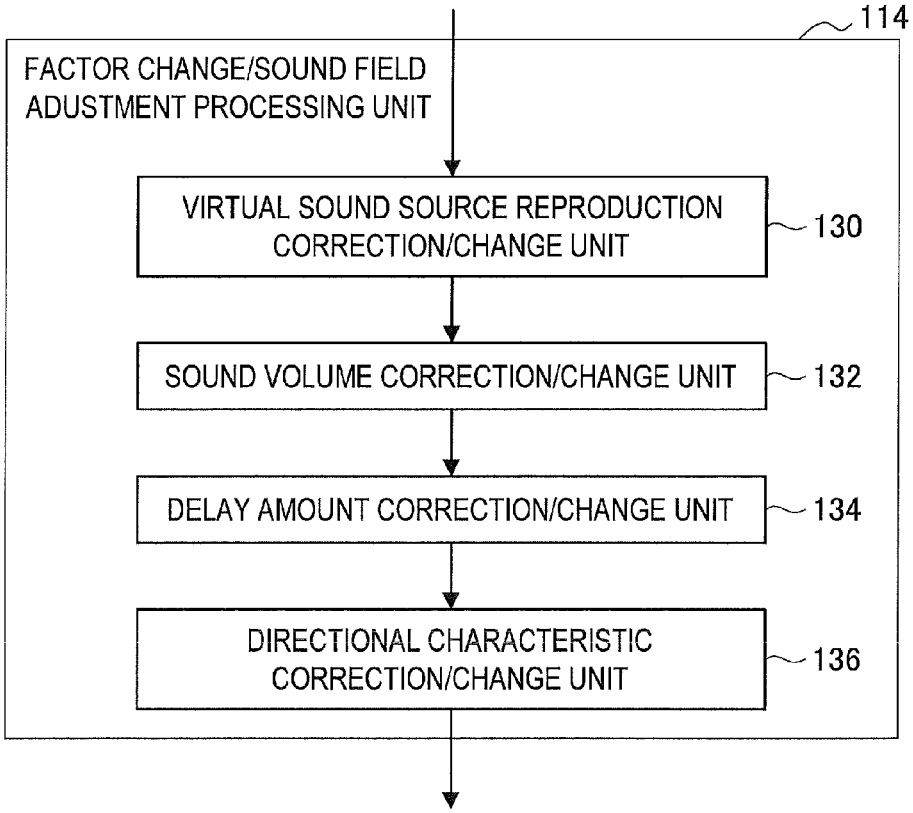
FIG. 4 is a schematic view showing a configuration of a factor change/sound field adjustment unit.

In the following, a configuration of the factor change/sound field adjustment unit 114 in FIG. 4 will be described. Based on a factor computed by the factor computation unit 112, a factor is changed and a sound field is adjusted. FIG. 4 is a schematic view showing a configuration of the factor change/sound field adjustment unit 114. As shown in FIG. 4, the factor change/sound field adjustment unit 114 is configured to have a virtual sound source reproduction correction/change unit 130, a sound volume correction/change unit 132, a delay amount correction/change unit 134, and a directional characteristic correction/change unit 136.

Basic processing in the factor change/sound field adjustment unit 114 is similar to the virtual sound source reproduction correction unit 120, the sound volume correction unit 122, the delay amount correction unit 124, and the directional characteristic correction 126 in FIG. 3. However, while the virtual sound field reproduction correction unit 120, the sound volume correction unit 122, the delay amount correction unit 124, and the directional characteristic correction unit 126 make a correction with a changed factor, each component of the factor change/sound field adjustment unit 114 makes a correction while changing from a previous factor to a target factor with a factor computed by the factor computation unit 112 as a target value. Then, the factor change/sound field adjustment unit 114 smoothly changes a factor so that waveform does not become discontinued when the factor is changed or no noise is generated or a user does not feel a sense of discomfort. The factor change/sound field adjustment unit 114 can be configured as a component integral with the sound field adjustment processing unit 116.

[1.4. Processing in the Sound Field Control Device]

Figure 5:
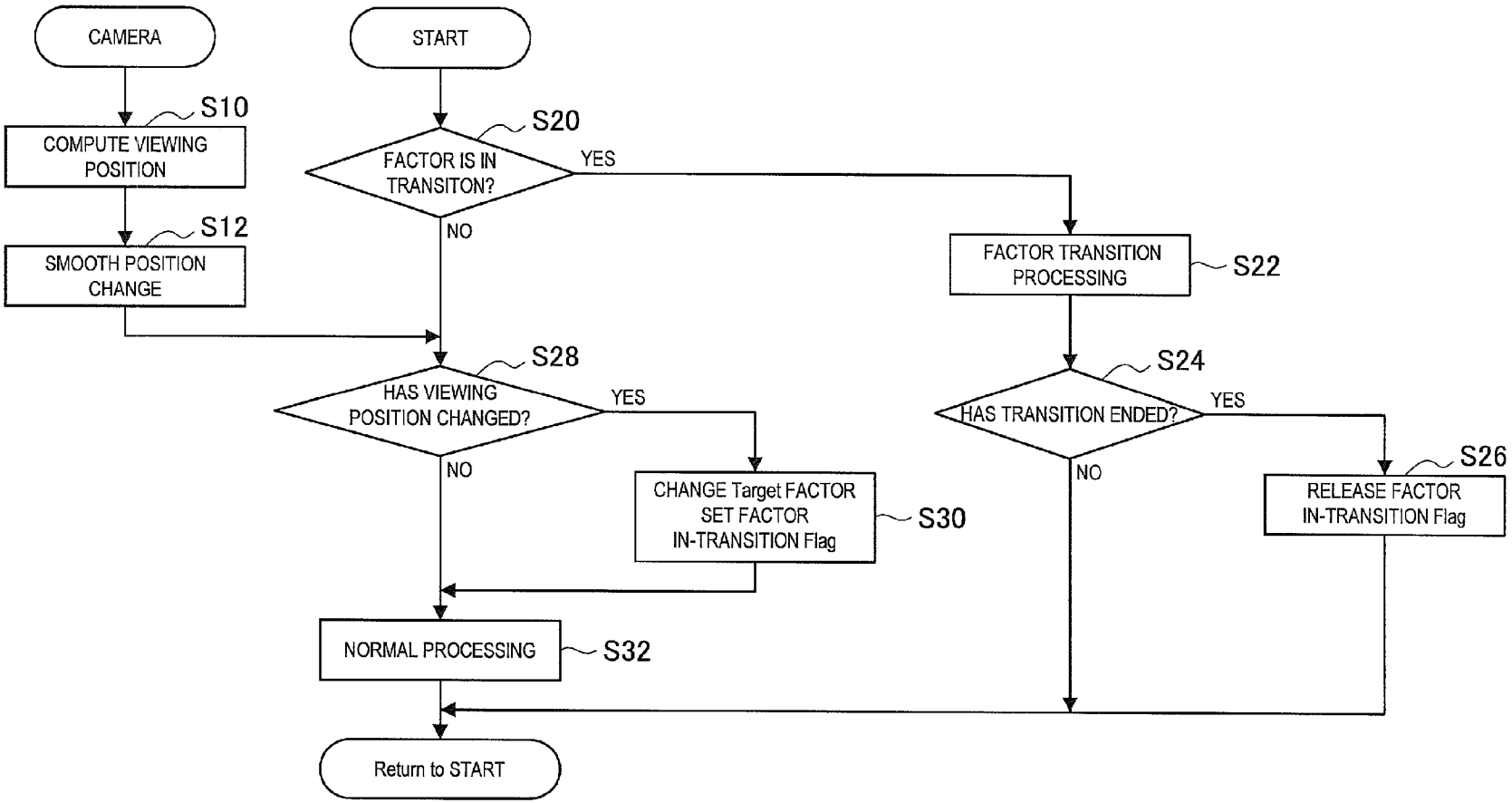
FIG. 5 is a flow chart showing processing of a first embodiment.

In the following, processing in the sound field control device 100 according to the embodiment will be described. FIG. 5 is a flow chart showing processing of the embodiment. In step S10, a camera computes a viewer position. In the next step S12, the camera performs smoothing of a change in the viewer position.

In addition, in step S20, it is determined based on a factor in-transition flag whether or not factor change processing is in transition. If the factor change processing is in transition (the factor in-transition flag is set), the process proceeds to step S22 where the factor transition processing is continuously performed. The factor transition process in step S22 corresponds to the processing of the factor change/sound field adjustment unit 114 described in FIG. 4.

Following step S22, the process proceeds to step S24. In step S24, it is determined whether or not the factor transition has ended. If the factor transition has ended, the process proceeds to step S26 where the factor in-transition flag is released. Following step S24, the process returns to START. On the one hand, if the factor transition has not ended in step S24, the process returns to START without releasing the factor in-transition flag.

In addition, in step S20, if the factor is not in transition (the factor in-transition flag is released), the process proceeds to step S28. In step S28, based on a result of the position change smoothing in step S12, it is determined whether or not the viewing position has changed. If the viewing position has changed, the process proceeds to step S30. In step S30, a target factor is changed and the factor in-transition flag is set. Following step S30, the process proceeds to step S32 where normal processing is performed.

On the one hand, in step S28, if the viewing position has not changed, the process proceeds to the normal processing in step S32 without setting the factor in-transition flag. Following step S32, the process returns to START.

[1.5. Positional Relationship Between a Viewer and a Sound Output Unit]

Figure 6:
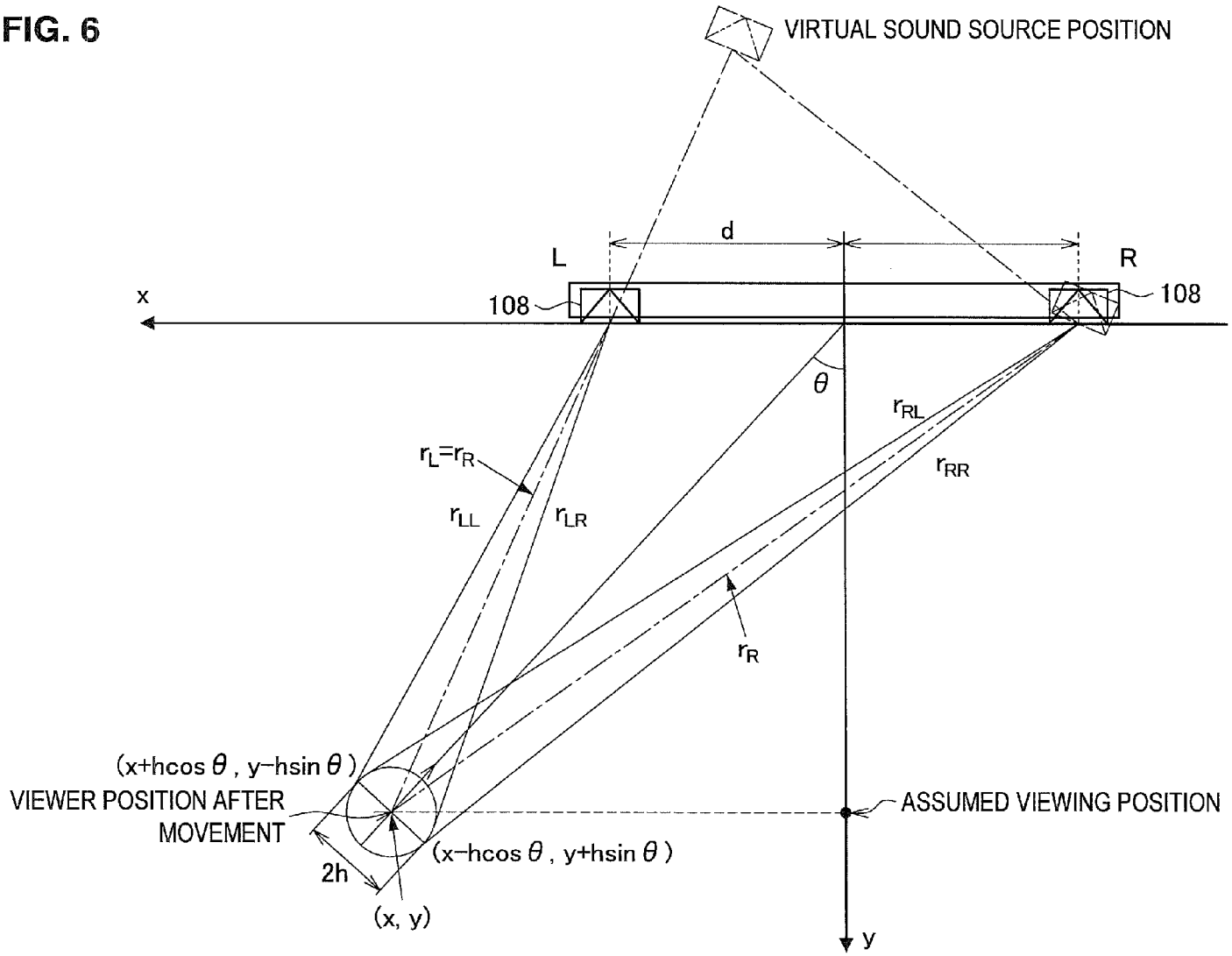
FIG. 6 is a schematic view showing a positional relationship between a viewer and a sound output unit (speaker).

FIG. 6 is a schematic view showing a positional relationship between the viewer and the sound output units (speakers) 108. When the viewer is present at an assumed viewing position in FIG. 6, any sound volume difference, arrival time difference and change in frequency characteristic do not occur in sounds reaching from the right and left sound output units 108. On the one hand, when the viewer moves to a viewer position after movement as shown in FIG. 6, a sound volume difference, an arrival time difference and a change in frequency characteristic occurs in the sounds reaching from the right and left sound output units 108.

If processing of the sound volume correction unit 122, the delay amount correction unit 124 and the directional characteristic correction unit 126 corrects the sound volume difference, the arrival time difference, and the change in the frequency characteristic, respectively, in the sounds reaching from respective speakers, the sounds are adjusted so that they have equal values to a case in which the left (L) sound output unit 108 in FIG. 6 is located at a virtual sound source position.

However, only with the processing of the sound volume correction unit 122, the delay amount correction unit 124 and the directional characteristic correction unit 126, the virtual sound source reproduction effect cannot be adequately corrected because an angular aperture of the speaker, a distance between the speaker and the viewer, and orientation of the viewer's face change. Thus, the virtual sound source reproduction correction/change unit 130 according to the embodiment makes a correction so as to obtain the virtual sound source reproduction effect.

[1.6. Processing in a Virtual Sound Source Reproduction Correction Unit]

The virtual sound source reproduction correction unit 120 changes each parameter for the virtual sound source reproduction. Main parameters include a head transfer function, direct sound, a delay amount in crosstalk and the like. That is, a change in the head transfer function due to a change in the angular aperture of the speaker (sound volume correction unit 122), the distance between the speaker and the viewer, the orientation of the viewer's face is corrected. In addition, in a case where a sound source is actually placed at the virtual sound source position, the virtual sound source reproduction correction unit 120 can address the change in the orientation of the viewer's face by making a correction to a difference in the direct sound and the delay amount in crosstalk.

In the following, a method for creating a head transfer function and a method for switching the head transfer function depending on a viewer position by the virtual sound source reproduction correction unit 120 of the first embodiment will be described.

(1) Measurement of a Head Transfer Function

Figure 16:
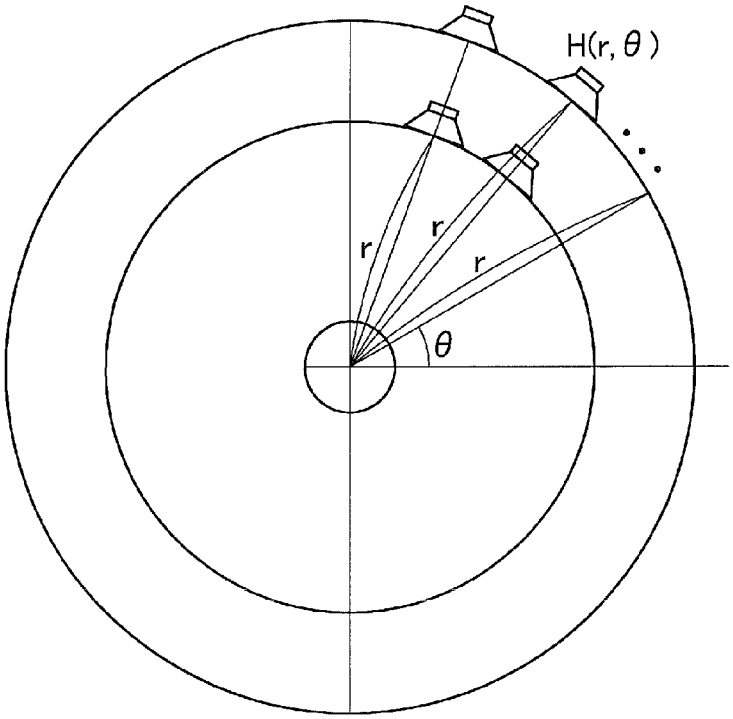
FIG. 16 is a schematic view showing how a head transfer function $H(r, \theta)$ is measured by using a dummy head and the like at each distance and angle around a viewer.

As shown in FIG. 16, a head transfer function H (r, θ) is measured by using a dummy head and the like at each distance and angle around a viewer.

(2) Computation of a Virtual Sound Source Reproduction Correction Factor

For example, computation of a virtual sound source reproduction correction factor at a viewing position 1 in FIG. 17 will be described. From data on the head transfer factor that has been measured in advance in (1) depending on position information determined by the viewing position computation unit, those corresponding to the following are used.

$H^1_{LL}$: Head transfer function from a sound source $SP_L$ to a left ear at the viewing position 1

$H^1_{LR}$: Hcad transfer function from the sound source $SP_L$ to a right ear at the viewing position 1

$H^1_{RL}$: Head transfer function from a sound source $SP_R$ to the left ear at the viewing position 1

$H^1_{RR}$: Head transfer function from the sound source $SP_R$ to the right ear at the viewing position 1

$H^1_L$: Head transfer function from a virtual sound source $SP^1_V$ to the left ear at the viewing position 1

$H^1_R$: Head transfer function from the virtual sound source $SP^1_V$ to the right ear at the viewing position 1

Using the head transfer functions mentioned above, the virtual sound source reproduction correction factor is determined as shown below:

$$S_L^1 = \frac{H_{RR}^1 H_L^1 - H_{RL}^1 H_R^1}{H_{RR}^1 H_{LL}^1 - H_{RL}^1 H_{LR}^1} \qquad S_R^1 = \frac{H_{LR}^1 H_L^1 - H_{LL}^1 H_R^1}{H_{LR}^1 H_{RL}^1 - H_L^1 H_{RR}^1} \quad \text{[Math. 1]}$$

Note that in the above expressions, $S^1_L$: Transfer function for correcting a sound from $SP_L$ at the viewing position 1

$S^1_R$: Transfer function for correcting a sound from $SP_R$ at the viewing position 1.

In addition, since it can be considered in an approximate manner that $S^P_L$ and $S^P_R$ are corrected to an equal distance/identical angle by the sound volume correction unit, the delay amount correction unit, and the directional characteristic correction unit, approximation can be performed such as $H^1_{LL}=H^1_{RR}$ and $H^1_{LR}=H^1_{RL}$. Therefore, as shown below, the virtual sound source reproduction correction factor can be determined from a smaller number of tables.

$$\hat{S}_L^1 = \frac{H_{LL}^1 H_L^1 - H_{LR}^1 H_R^1}{\{H_{LL}^1\}^2 - \{H_{LR}^1\}^2} \qquad \hat{S}_R = \frac{H_{LL}^1 H_R^1 - H_{LR}^1 H_L^1}{\{H_{LL}^1\}^2 - \{H_{LR}^1\}} \quad \text{[Math. 2]}$$

(3) Switching of Head Transfer Functions

Figure 17:
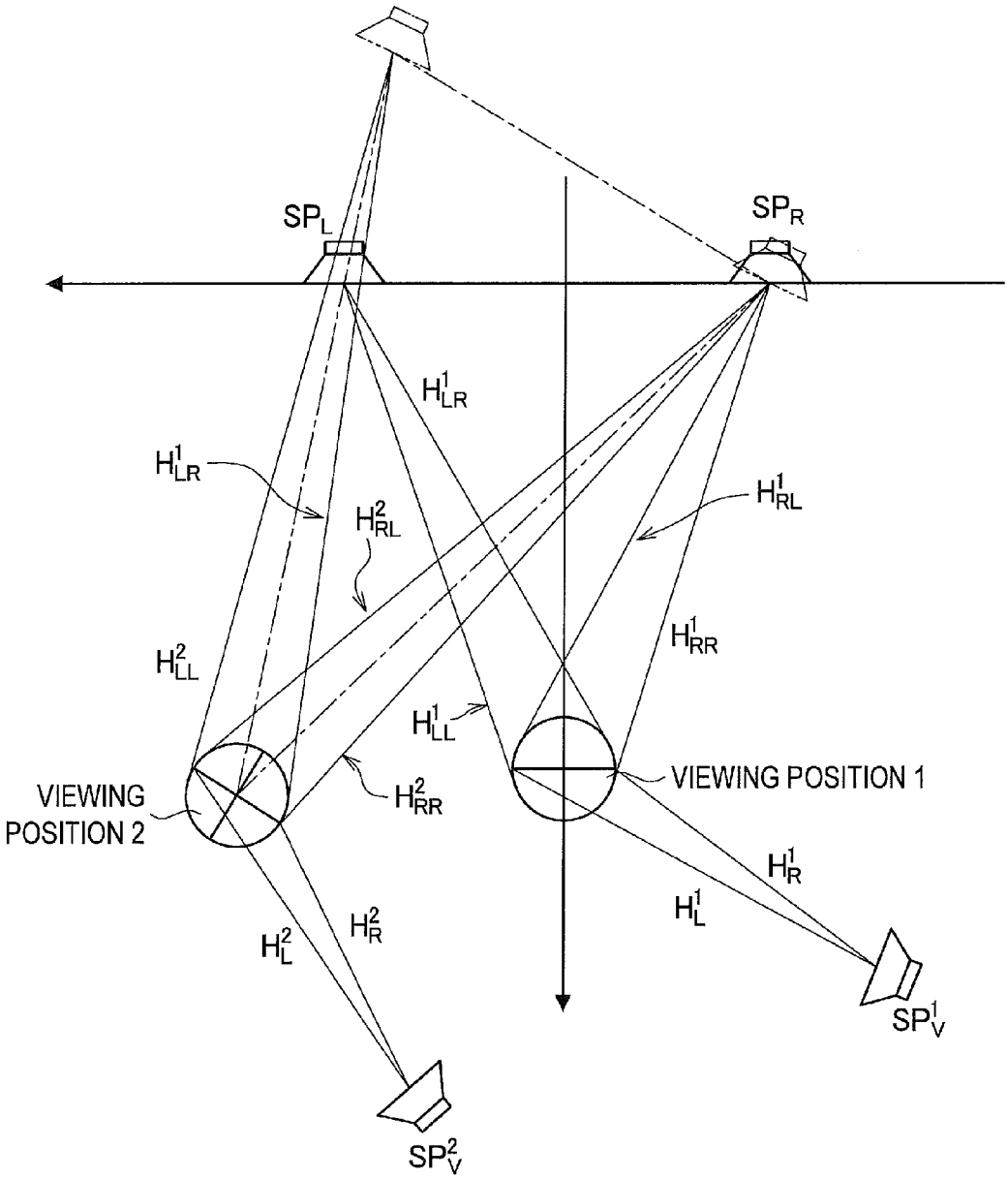
FIG. 17 is a schematic view for illustrating computation of a virtual sound source reproduction correction factor.

For example, in FIG. 17, if a viewer moves to a viewing position 2, and the factor change determination unit determines that a factor is to be changed, a virtual sound source reproduction correction factor is computed with a method similar to the above. However, since a virtual sound source position to the viewer is fixed, it can be considered that $H^1_L=H^2_L$ and $H^1_R=H^2_R$.

$$S_L^2 = \frac{H_{RR}^2 H_L^2 - H_{RL}^2 H_R^2}{H_{RR}^2 H_{LL}^2 - H_{RL}^2 H_{LR}^2} = \frac{H_{RR}^2 H_L^1 - H_{RL}^2 H_R^1}{H_{RR}^2 H_{LL}^2 - H_{RL}^2 H_{LR}^2} \qquad S_R^2 = \frac{H_{LR}^2 H_L^2 - H_{LL}^2 H_R^2}{H_{LR}^2 H_{RL}^2 - H_{LL}^2 H_{RR}^2} = \frac{H_{LR}^2 H_L^1 - H_{LL}^2 H_R^1}{H_{LR}^2 H_{RL}^2 - H_{LL}^2 H_{RR}^2} \quad \text{[Math. 3]}$$

$H^2_{LL}$: Head transfer function from the sound source $SP_L$ to the left ear at the viewing position 2

$H^2_{LR}$: Head transfer function from the sound source $SP_L$ to the right ear at the viewing position 2

$H^2_{RL}$: Head transfer function from the sound source $SP_R$ to the left ear at the viewing position 2

$H^2_{RR}$: Head transfer function from the sound source $SP_R$ to the right ear at the viewing position 2

$H^2_L$: Head transfer function from a virtual sound source $SP^2v$ to the left ear at the viewing position 2

$H^2_R$: Head transfer function from the virtual sound source $SP^2v$ to the right ear at the viewing position 2

$S^2_L$: Transfer function for correcting a sound from SPL at the viewing position 2

$S^2_R$: Transfer function for correcting a sound from SPR at the viewing position 2

Note that for a reason similar to the above, approximation can be performed such as $H^2_{LL}=H^2_{RR}$ and $H^2_{LR}=H^2_{RL}$. Therefore, as shown below, the virtual sound source reproduction correction factor can be determined from a smaller number of tables.

$$\hat{S}_L^2 = \frac{H_{LL}^2 H_L^2 - H_{LR}^2 H_R^2}{\{H_{LL}^2\}^2 - \{H_{LR}^2\}^2} = \frac{H_{LL}^2 H_L^1 - H_{LR}^2 H_R^1}{\{H_{LL}^2\}^2 - \{H_{LR}^2\}^2} \qquad \hat{S}_R^2 = \frac{H_{LL}^2 H_R^2 - H_{LR}^2 H_L^2}{\{H_{LL}^2\}^2 - \{H_{LR}^2\}^2} = \frac{H_{LL}^2 H_R^1 - H_{LR}^2 H_L^1}{\{H_{LL}^2\}^2 - \{H_{LR}^2\}^2} \quad \text{[Math. 4]}$$

In addition, processing of the sound volume correction unit 122, the delay amount correction unit 124, and the directional characteristic correction unit 126 can be considered as a change in head transfer functions. However, when a correction is made only with the head transfer functions, data of the head transfer functions corresponding to each position must be held, which thus extends the tone. Therefore, it is preferred to divide the head transfer functions into respective parts.

[1.7. Processing in a Sound Volume Correction/Change Unit]

Figure 7:
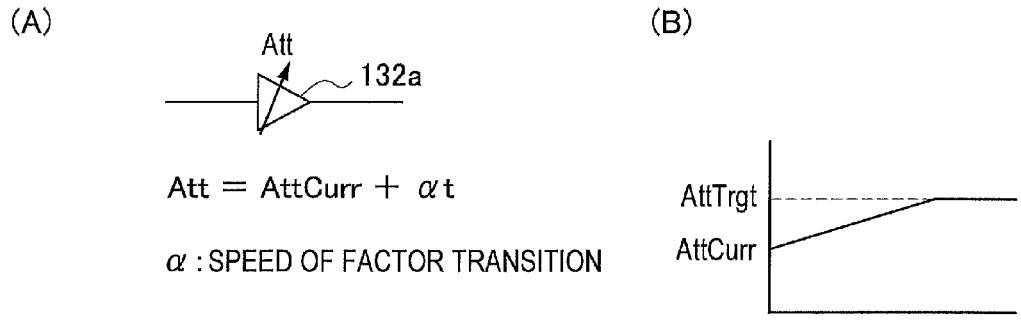
FIG. 7 is a schematic view for illustrating processing to be performed in a sound volume correction/change unit.

FIG. 7 is a schematic view for illustrating processing to be performed in the sound volume correction/change unit 132. Now, FIG. 7(A) shows a specific configuration of the sound volume correction/change unit 132. In addition, FIG. 7(B) also shows how sound volume is corrected by the sound volume correction/change unit 132.

As shown in FIG. 7(A), the sound volume correction/change unit 132 consists of a variable attenuator 132*a*. As shown in FIG. 7(B), sound volume linearly varies from a value AttCurr before a change to a value AttTrgt after the change. Sound volume to be outputted from the sound volume correction/change unit 132 is expressed by the following expression. However, t is time. With this, the sound volume can be changed smoothly so as to reliably prevent the viewer from having a sense of discomfort.

$$Att=AttCurr+\alpha t$$

[1.8. Processing in a delay amount correction/change unit]

Figure 8:
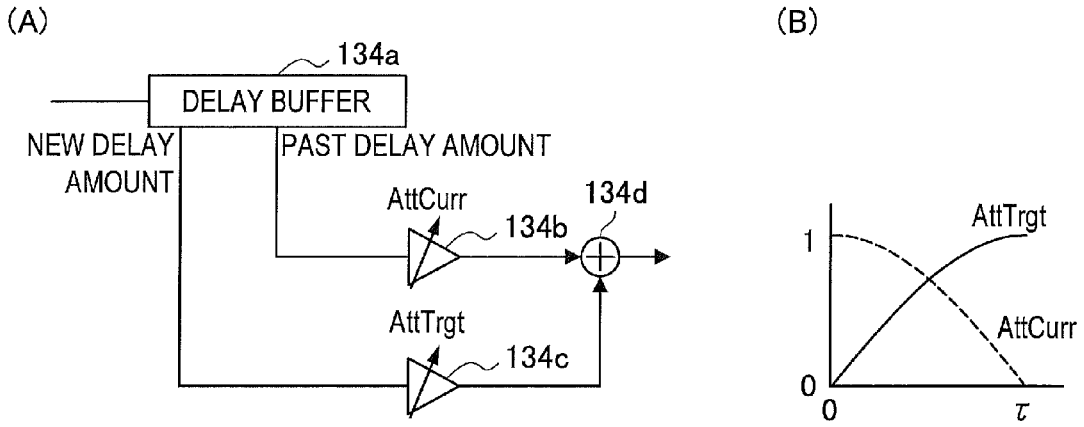
FIG. 8 is a schematic view for illustrating processing to be performed in a delay amount correction/change unit.

FIG. 8 is a schematic view for illustrating processing to be performed in the delay amount correction/change unit 134. The delay amount correction/change unit 134 changes a delay amount by smoothly varying a proportion of mixing two signals having different delay amounts. Now, FIG. 8(A) shows a specific configuration of the delay amount correction/change unit 134. In addition, FIG. 8(B) is a characteristic diagram showing how sound volume is corrected by the delay amount correction/change unit 134.

As shown in FIG. 8(A), the delay amount correction/change unit 134 consists of a delay buffer 134*a*, variable attenuators 134*b*, 134*c*, and an addition unit 134*d*. The attenuator 134*b* adjusts a gain of a past delay amount AttCurr outputted from the delay buffer 134*a*. In addition, the attenuator 134*c* adjusts a gain of a new delay amount AttTrgt outputted from the delay buffer 134*a*.

As shown in FIG. 8(B), the attenuator 134*b* such controls that as time elapses, the gain of the past delay amount AttCurr decreases from 1 to 0 along a sine curve. In addition, as shown in FIG. 8(B), the attenuator 134*c* such controls that as time elapses, the gain of the new delay amount AttTrgt increases from 0 to 1 along a sine curve.

The addition unit 132*d* adds the past delay amount AttCurr outputted from the attenuator 134*b* to the new delay amount AttTrgt outputted from the attenuator 134*c*. This enables a smooth change from the past delay amount AttCurr to the new delay amount AttTrgt as time elapses.

[1.9. Processing in a Virtual Sound Source Reproduction Correction/Change Unit and a Directional Characteristic Correction/Change Unit]

Figure 9:
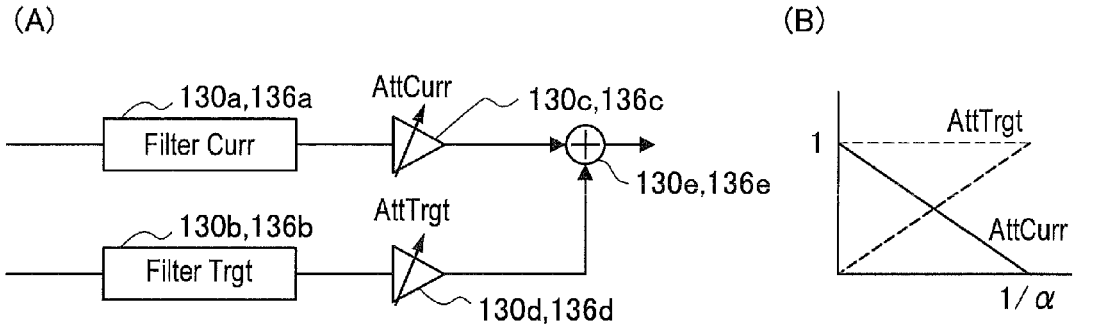
FIG. 9 is a schematic view for illustrating processing to be performed in a virtual sound source reproduction correction/change unit and a directional characteristic correction/change unit.

FIG. 9 is a schematic view for illustrating processing to be performed in the virtual sound source reproduction correction/change unit 130 and the directional characteristic correction/change unit 136. The virtual sound source reproduction correction/change unit 130 and the directional characteristic correction/change unit 136 change a characteristic by smoothly changing a proportion of mixing two signals having different characteristics. Note that the factor change may be performed by being divided into a plurality of units.

As shown in FIG. 9, the virtual sound source reproduction correction/change unit 130 is configured to have a filter 130*a* for passing a signal before change, a filter 130*b* for passing a signal after change, an attenuator 130*c*, an attenuator 130*d*, and an addition unit 130*e*. The attenuator 130*c* adjusts a gain of a signal AttCurr outputted from the filter 130*a*. The attenuator 130*d* adjusts a gain of a signal AttTrgt outputted from the filter 130*b*.

As shown in FIG. 9(B), the attenuator 130*c* such controls that as time elapses, the gain of a past signal AttCurr linearly decreases from 1 to 0. In addition, as shown in FIG. 9(B), the attenuator 130*d* such controls that as time elapses, the gain of a new delay amount AttTrgt linearly increases from 0 to 1.

The addition unit 130*e* adds the past signal AttCurr outputted from the attenuator 130*c* to the new signal AttTrgt outputted from the attenuator 132*s*. This enables a smooth change from the past signal AttCurr to the new signal AttTrgt as time elapses.

Similarly, as shown in FIG. 9, the directional characteristic correction/change unit 136 is configured to have a filter 136*a* for passing a signal before change, a filter 136*b* for passing a signal after change, an attenuator 136*c*, an attenuator 136*d*, and an addition 136*e*. Processing in the directional characteristic correction/change 136 is similar to the processing to be performed in the virtual sound source reproduction correction/change unit 130.

[1.10. Specific Configuration Example of the Sound Field Control Device]

Figure 10:
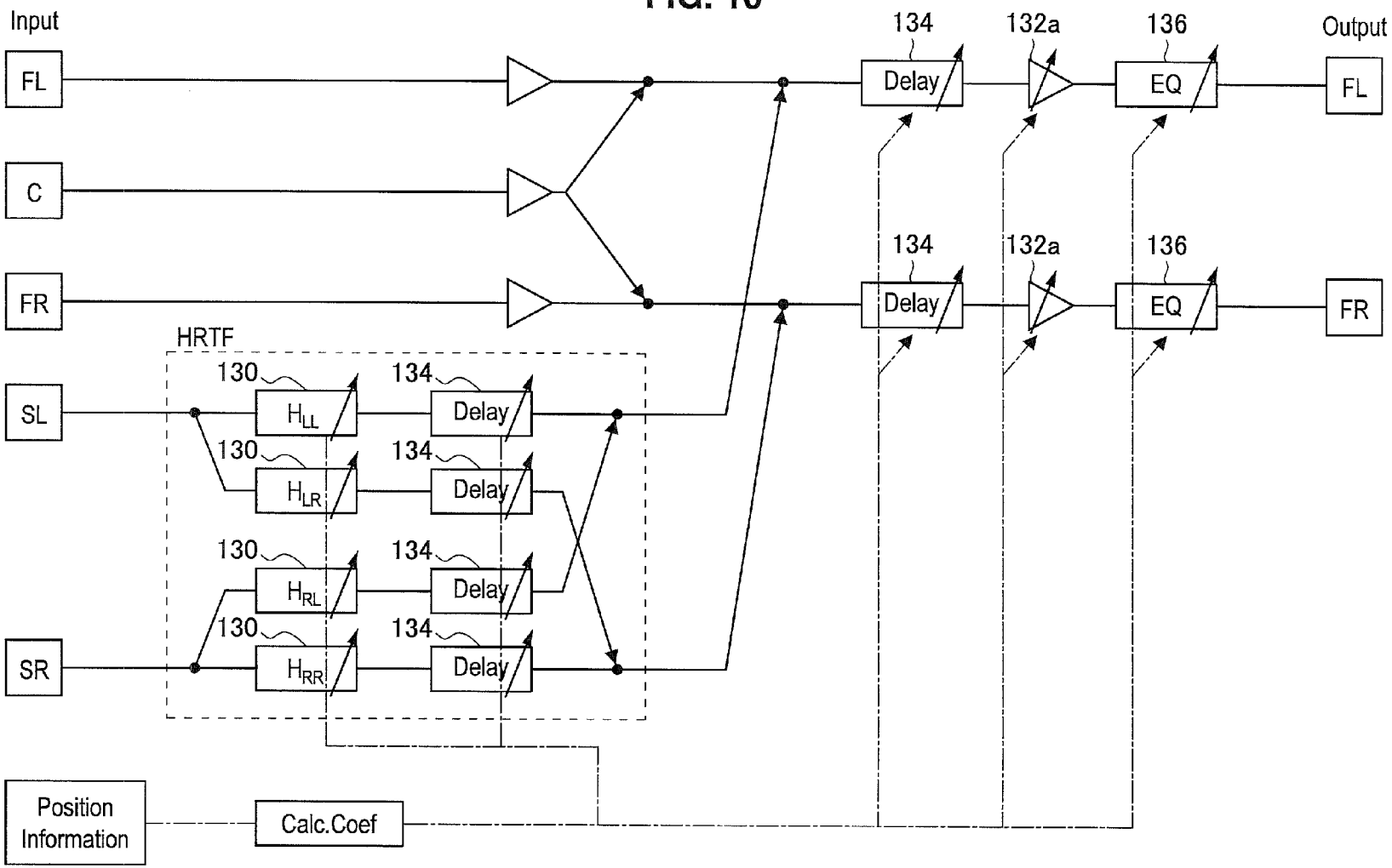
FIG. 10 is a schematic view showing a specific configuration of the sound field control device of this embodiment.

FIG. 10 is a schematic view showing a specific configuration of the sound field control device 100 of this embodiment. As shown in FIG. 10, in the sound field control deice 100, input sound outputted from sound sources FL, C, FR, SL, and SR are outputted by passing through the virtual sound source reproduction correction/change unit 130, the sound volume correction/change unit 132, the delay amount correction/change unit 134, and the directional characteristic correction/change unit 136.

With the above configuration, a viewer can obtain the appropriate virtual sound source reproduction effect and feel an appropriate normal position or spatial expanse.

Note that it is also possible to perform correction processing for a plurality of persons by using a plurality of speakers. In the case of the plurality of persons, performing the virtual sound source reproduction correction, in particular, is effective.

As described above, according to the first embodiment, since each parameter is changed for the virtual sound source reproduction on the basis of a viewer position, the virtual sound source reproduction effect can be obtained irrespective of a viewing position, thereby making it possible to feel an appropriate normal position or spatial expanse.

In addition, provision of the viewing position computation unit 104 for real-time detecting positional relationships among and angles of a viewer and a plurality of speakers enables real-time detection of a change in the positional relationships among the plurality of speakers and the viewer. Then, based on a computation result from the viewing position computation unit 104, a positional relationship of each of the plurality of speakers with respect to the viewer is computed. Since a sound signal output parameter is set for each of the plurality of speakers from the computation result, the sound signal output parameter can be set in response to a real-time change in the positional relationships of the plurality of speakers and the viewer. With this, even when the viewer moves, sound volume, a delay, a directional characteristic, and a head transfer function of a sound from each speaker can be modified to provide the viewer with optimal sound state and virtual sound source reproduction effect.

In addition, since a factor is changed when a computation result of the viewing position computation unit 104 changes more than a predetermined amount, and when the computation result is stabilized for a predetermined period of time or longer, alleviation of a sense of discomfort due to excessive factor changing or the control efficiency can be improved.

Furthermore, since a factor is smoothly changed so that no discontinuous waveform is generated, noise does not occur. Thus, it is possible to follow a change in a viewing position without causing a sense of discomfort and continuously provide an appropriate sound field real time.

In addition, since a sound image normal position, which is a target of the virtual sound source reproduction, can be freely changed, the sound image normal position can be dynamically changed, such as fixing the sound image to a space, for example.

(2. Second Embodiment)

[2.1. Overview of a Second Embodiment]

Figure 11:
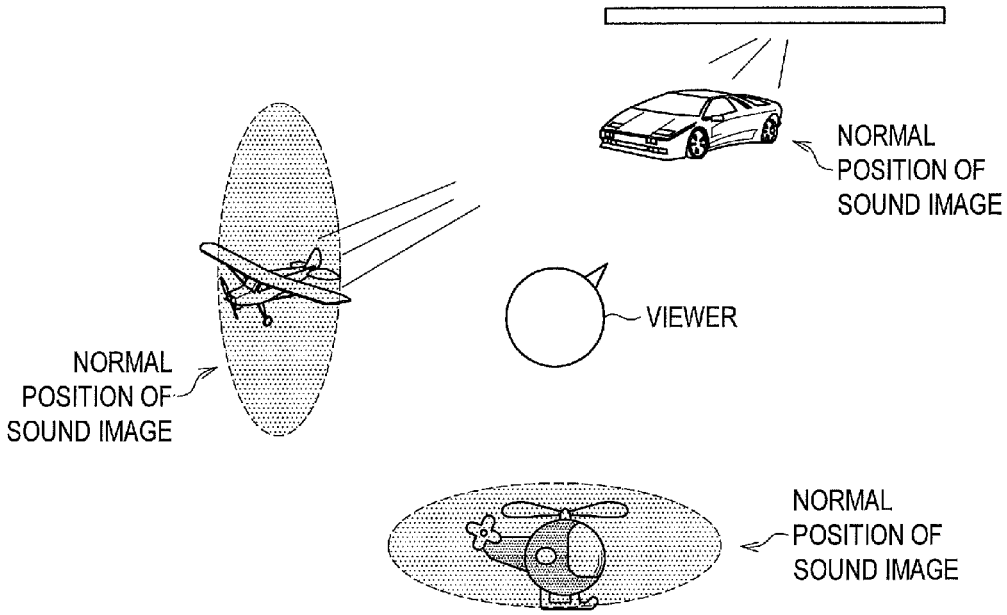
FIG. 11 is a schematic view showing a normal position of a sound image of the first embodiment.

In the following, a second embodiment of the present disclosure will be described. In the first embodiment as described above, the configuration for making a correction so that the virtual sound source reproduction effect can be maintained when a viewing position is displaced is shown. Specifically, as shown in FIG. 11, even if the viewer moves, a normal position of a sound image is maintained relatively to the viewer, and the normal position of the sound image moves with the viewer.

Figure 12:
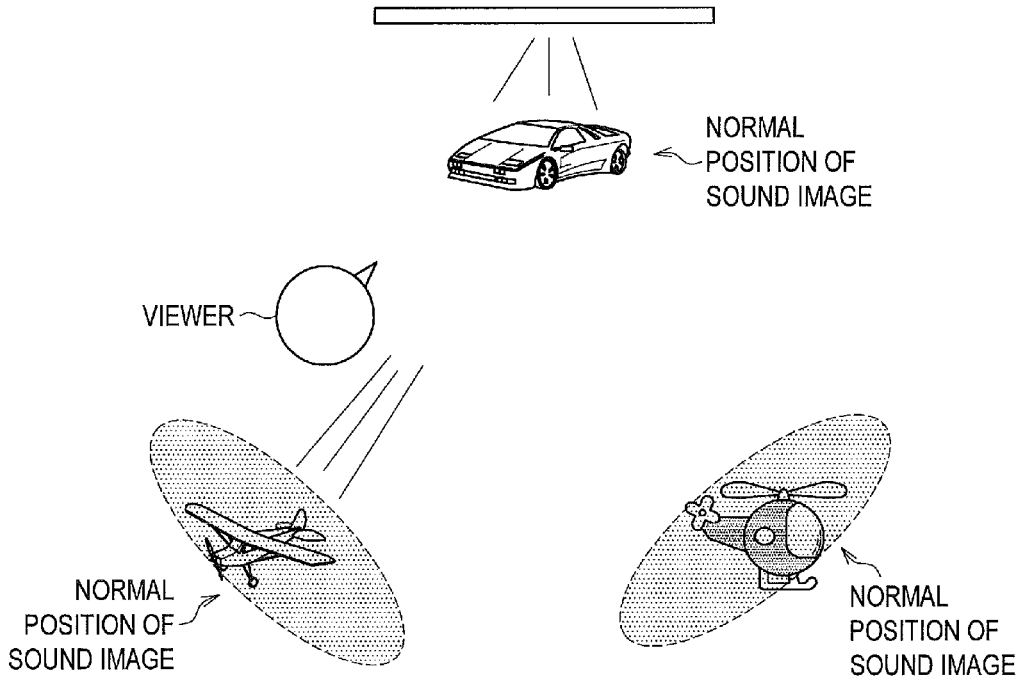
FIG. 12 is a schematic view showing a normal position of a sound image of a second embodiment.

In contrast to this, the second embodiment shows an example in which the virtual sound source reproduction effect is positively changed in response to a change of a viewer position. Specifically, as shown in FIG. 12, a normal position of a sound image is maintained absolutely to a space, thus enabling the viewer to have a perception of moving in the space by move in that space.

A configuration of a sound field control device 100 according to the second embodiment is similar to FIG. 1 to FIG. 4 of the first embodiment, and a method for controlling sound volume, a delay, and speaker directional characteristics is similar to the first embodiment. However, in the virtual sound source reproduction correction/change unit 130 of FIG. 4, a normal position is changed depending on a position so that the normal position is fixed to a space.

[2.2. Processing to be Performed in a Virtual Sound Source Reproduction Correction/Change Unit of the Second Embodiment]

In the following, a method for creating a head transfer function and a method for switching the head transfer function depending on a viewer position in the second embodiment will be described.

Figure 18:
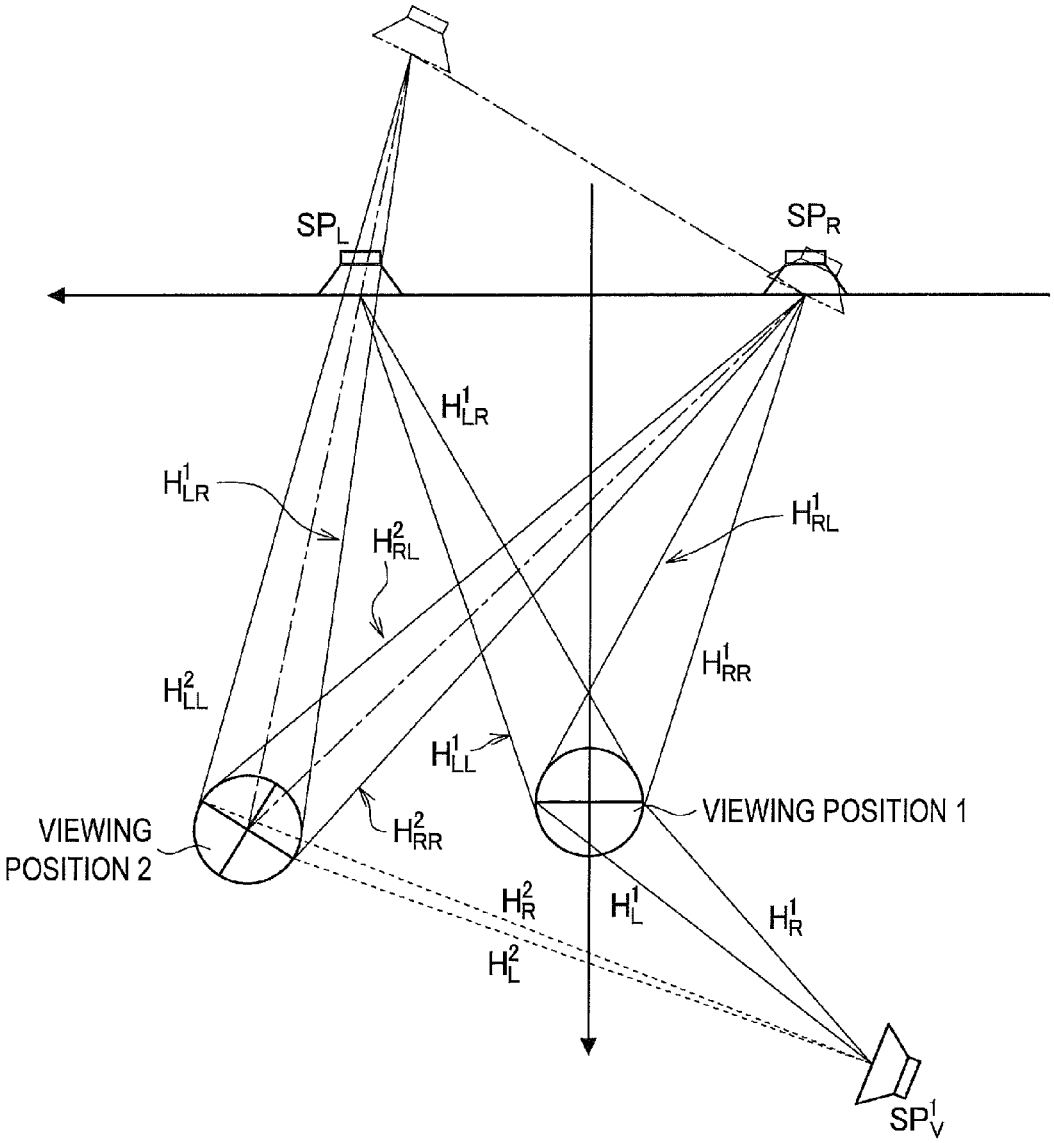
FIG. 18 is a schematic view showing a method for changing a factor (head transfer function) of a virtual sound source reproduction correction unit so that a normal position of a virtual sound source is fixed to a space with respect to movement of a viewer.

FIG. 18 shows one example of a method for changing a factor (head transfer function) of the virtual sound source reproduction correction unit so that a normal position of a virtual sound source is fixed to a space with respect to movement of a viewer. Similar to the first method, a virtual sound source reproduction correction factor at a viewing position is computed.

$$S_L^1 = \frac{H_{RR}^1 H_L^1 - H_{RL}^1 H_R^1}{H_{RR}^1 H_{LL}^1 - H_{RL}^1 H_{LR}^1} \quad \text{[Math. 5]}$$

$$S_R^1 = \frac{H_{LR}^1 H_L^1 - H_{LL}^1 H_R^1}{H_{LR}^1 H_{RL}^1 - H_{LL}^1 H_{RR}^1}$$

Now, when the viewer moves to a viewing position 2, unlike the embodiment 1, a position of the virtual sound source relative to the viewer considerably changes. Thus, it is essential to change from $H^1{}_L$, $H^1{}_R$ to $H^2{}_L$, $H^2{}_R$.

$$S_L^2 = \frac{H_{RR}^2 H_L^2 - H_{RL}^2 H_R^2}{H_{RR}^2 H_{LL}^2 - H_{RL}^2 H_{LR}^2} \quad \text{[Math. 6]}$$

$$S_R^2 = \frac{H_{LR}^2 H_L^2 - H_{LL}^2 H_R^2}{H_{LR}^2 H_{RL}^2 - H_{LL}^2 H_{RR}^2}$$

As described above, according to the second embodiment, since the virtual sound source reproduction correction/change unit 130 performs processing so that a normal position of a sound image is maintained absolutely to a space, a viewer can have a perception of moving in the space by move in that space.

(3. Third Embodiment)

[3.1. Overview of a Third Embodiment]

Figure 13:
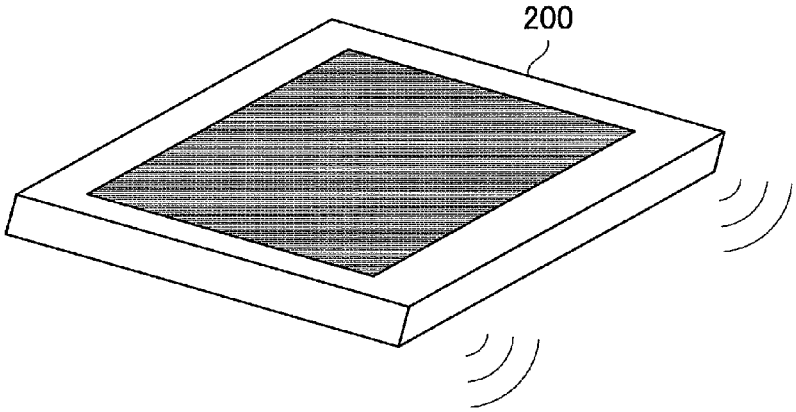
FIG. 13 is a schematic view showing an application example to such a device as a tablet or a personal computer in a third embodiment.

In the following, a third embodiment of the present disclosure will be described. As shown in FIG. 13, the third embodiment shows an application example to a device 300 such as a tablet or a personal computer and the like. In such a device 300 as a mobile like a tablet, in particular, since a viewer may hold a main body with his or her hand, a change in a height direction or a change in an angle has an influence on a sound and in some cases, the influence becomes too large to be ignored. In addition, in some cases, the viewer does not move but the device 300 itself having a display unit and a sound reproduction unit may move or rotate.

[3.2. Configuration Example of the Third Embodiment]

Figure 14:
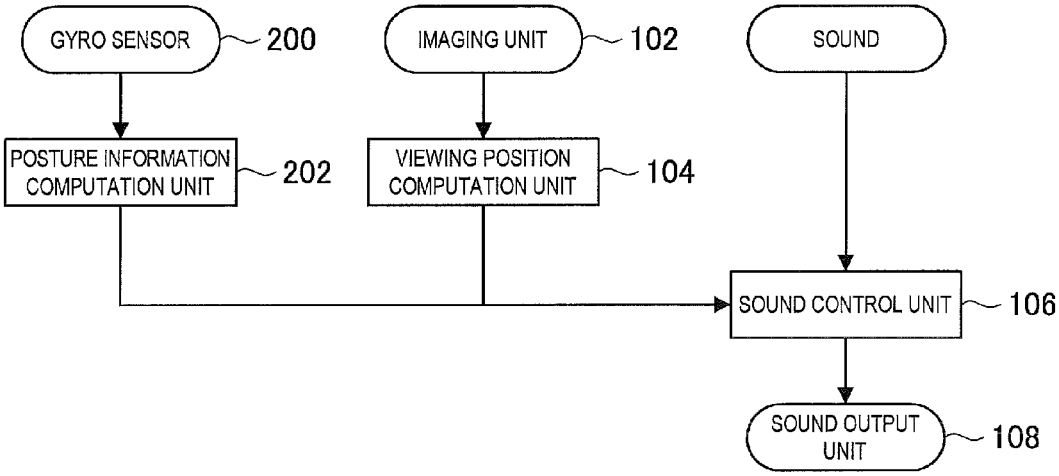
FIG. 14 is a schematic view showing a configuration example of the third embodiment.

FIG. 14 is a schematic view showing a configuration example of the third embodiment. To the configuration example of FIG. 1 are added a gyro sensor 200 and a posture information computation unit 202. As shown in FIG. 14, a rotation direction of the device can be detected by utilizing the gyro sensor 200. The posture information computation unit 202 computes information on posture of the device, on the basis of the detected value of the gyro sensor 200 and compute a position and orientation of a sound output unit 108.

With this, even when a camera is not mounted on the device 300 or a function is turned off (OFF), for example, posture of the device can be computed from the gyro sensor and a viewing position can be expected. Therefore, based on a viewing position, sound field correction processing similar to the first embodiment can be performed. A specific configuration of a sound control unit 106 is similar to the first embodiment as shown in FIG. 2 to FIG. 4.

(4. Fourth Embodiment)

Figure 15:
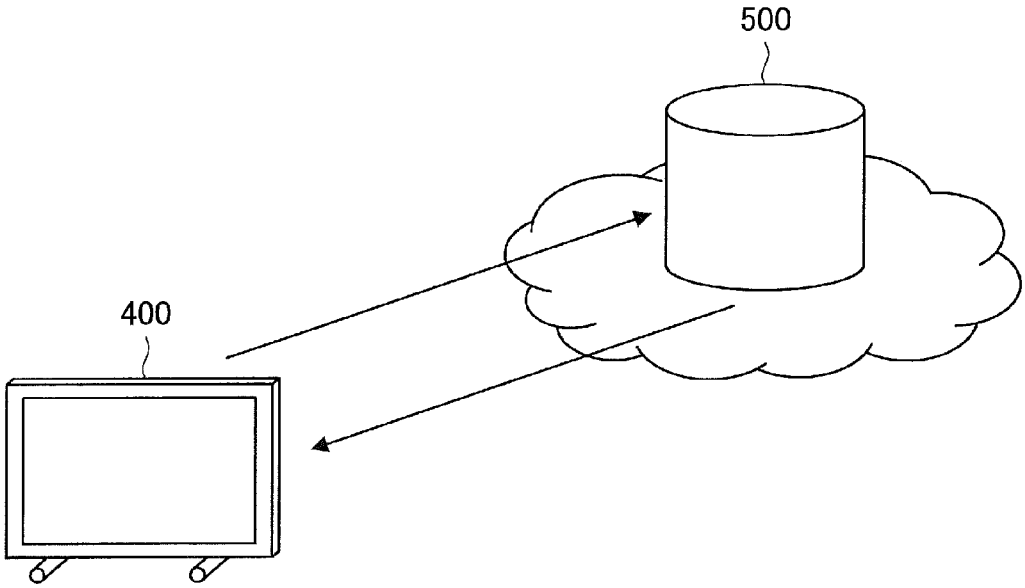
FIG. 15 is a schematic view showing a configuration example of a fourth embodiment.

In the following, a fourth embodiment of the present disclosure will be described. FIG. 15 is a schematic view showing a configuration example of a fourth embodiment. In the fourth embodiment, the processing of a sound field control device 100 described above is performed not on a main body of a device 400 including a sound field control device 100 but on the side of a cloud computer 500. Use of the cloud computer 500 makes it possible to hold a huge volume of database of head transfer functions or implement rich sound field processing.

(5. Fifth Embodiment)

In the following, a fifth embodiment of the present disclosure will be described. As described above, the imaging unit 102 (and the viewing position computation unit 104) in the first embodiment may be provided in a separate device from a device in which a sound field control device 100 is provided. The fifth embodiment illustrates a configuration in which an imaging unit 102 is provided in a separate device from a device in which a sound field control device 100 is provided.

Figure 20:
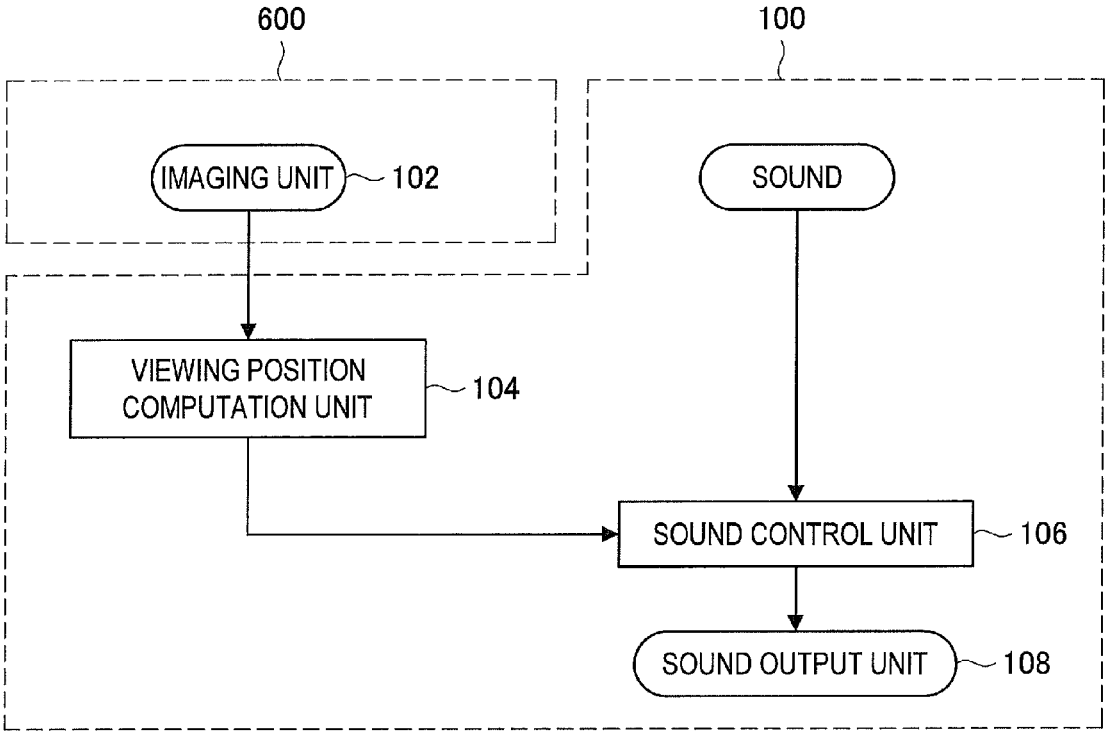
FIG. 20 is a schematic view showing a configuration example of a system in a fifth embodiment.

FIG. 20 is a schematic view showing a configuration example of a system in the fifth embodiment. As shown in FIG. 20, in the fifth embodiment, the imaging unit 102 is provided in a device 600 which is separate from the sound field control unit 100. The device 600 may be a device such as a DVD player and the like, which records video/sound of a television receiver if the sound field control device 100 is the television receiver. In addition, the device 600 may be a standalone imaging device (camera).

In the system of FIG. 20, an image of a viewer imaged by the imaging unit 102 is sent to the sound field control device 100. In the sound field control device 100, based on the image of the viewer, a viewing position computation unit 104 computes a viewer position. Subsequent processing is similar to the first embodiment. With the above, the sound field control device 100 can control a sound field on the basis of the image imaged by other device 600.

(6. Sixth Embodiment)

In the following, a sixth embodiment of the present disclosure will be described. The sixth embodiment illustrates a case in which a normal position of a sound changes real time by manipulation of a user, such as a case in which a game is played on a personal computer or a tablet and the like.

When a user plays a game, a position of a sound source may move with a position of a display target object (display object) on a screen. For example, when a display target object such as a character, a car, an airplane and the like moves on the screen, a sense of reality can be enhanced by moving the position of the sound source of the display target object as the display target object moves. Also, when the display target object is displayed in three dimensions, the sense of reality can be enhanced by moving the position of the sound field accompanying movement of the display target object in a three-dimensional direction.

Such a movement of the display target object occurs as the game progresses or also occurs as a result of manipulation of the user.

In the case of a game, similar to FIG. 12, the virtual sound source reproduction effect is positively changed. Then, the virtual sound source reproduction effect is changed depending on a position of the display target object, so that sound is generated as a position of the display target object becomes a virtual sound source position.

In this manner, when a normal position of a sound changes real time, an appropriate HRTF is dynamically computed considering a relative position of the virtual sound source position, in addition to information on the viewer (user) position and a reproduced sound source position. Since the virtual sound source position SPv changes real time in FIG. 17, $H_L$ and $H_R$ are sequentially changed to compute a virtual sound source reproduction correction factor (virtual sound source reproduction filter) with the following expression. Specifically, the virtual sound source position SPv corresponds to the position of the display target object and in the following expression, $H_L$ and $H_R$ in the mathematical expression (Math. 1) described in the first embodiment are made time functions $H_L(t)$ and $H_R(t)$. With this, a position of the virtual sound source can be changed real time, depending on a position of the display target object.

$$S_L = \frac{H_{RR}H_L(t) - H_{RL}H_R(t)}{H_{RR}H_{LL} - H_{RL}H_{LR}} \quad \text{[Math. 7]}$$

$$S_R = \frac{H_{LR}H_L(t) - H_{LL}H_R(t)}{H_{LR}H_{RL} - H_{LL}H_{RR}}$$

Figure 21:
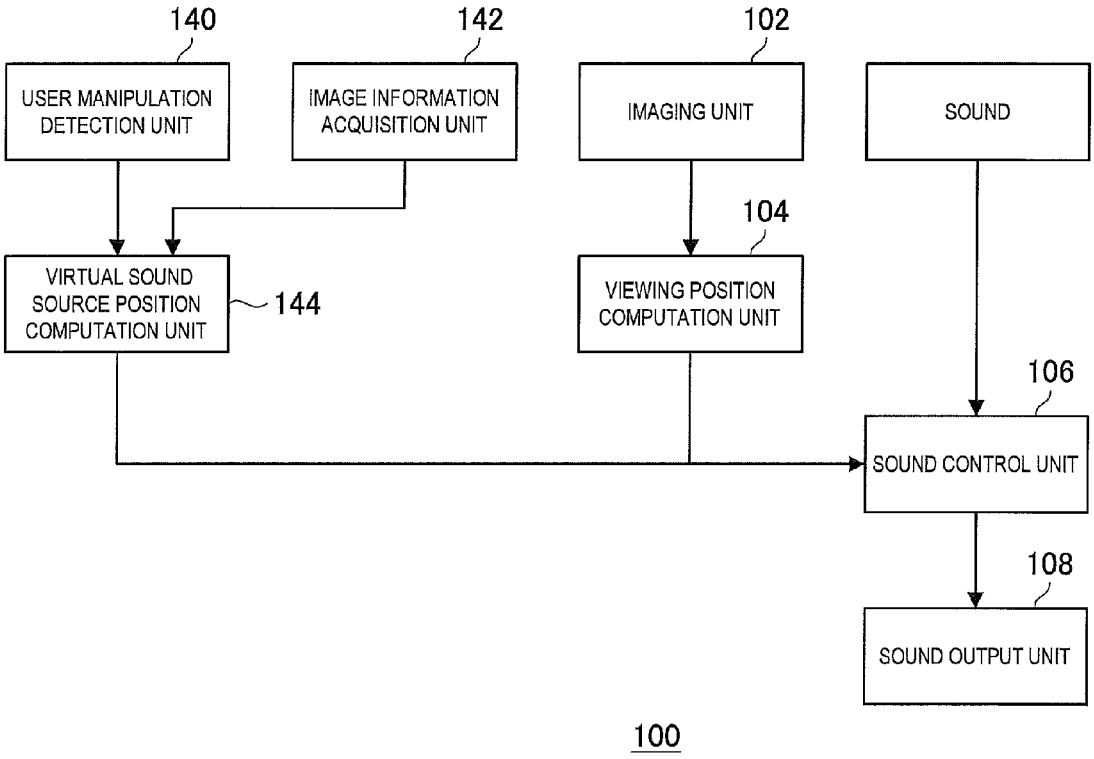
FIG. 21 is a schematic view showing a configuration example of a sound field control device according to a sixth embodiment.

FIG. 21 is a schematic view showing a configuration example of a sound field control device 100 according to a sixth embodiment. As shown in FIG. 21, the sound field control device 100 is configured to have a user manipulation detection unit 140, an image information acquisition unit 142, and a virtual sound source position computation unit 144, in addition to the configuration of FIG. 1. The user manipulation detection unit 140 detects manipulation of a user with a manipulation member such as a button, a touch panel, a keyboard, a mouse and the like. The image information acquisition unit 142 acquires information on a position or motion of a display target object, and the like. The image information acquisition unit 142 acquires a two-dimensional position of the display object in a display screen. In addition, when displaying in three dimensions is performed, the image information acquisition unit 142 acquires a position (depth position) of the display target object in a direction perpendicular to the display screen, on the basis of aberrations of an image for the left eye and an image for the right eye. The virtual sound source position computation unit 144 computes a position of a virtual sound source, on the basis of the information on user manipulations or the information on the position, the motion and the like of the display target object.

A sound control unit 106 performs control similar to the first embodiment. Now, a virtual sound source reproduction correction unit 120 included in the sound control unit 106 sequentially changes $H_L(t)$ and $H_R(t)$ as time elapses with the above mathematical expression, on the basis of the position of the virtual sound source computed by the virtual sound source position computation unit 144, to compute the virtual sound source reproduction correction factor. With this, the position of the virtual sound source can be changed real time, depending on the position of the display target object.

As described above, according to the sixth embodiment, in such a case as a game in which a display target object moves while generating sound, a position of the virtual sound source can be changed real time with a position of the display target object. Therefore, a sound field with a sense of reality depending on a position of a display target object can be provided.

(7. Seventh Embodiment)

In the following, a seventh embodiment of the present disclosure will be described. As described in the sixth embodiment, when a virtual sound source position is controlled depending on a position of a display target object of a game, for example, a volume of computation by a CPU increases. Thus, load becomes too heavy for a CPU incorporated in a tablet, a smart phone and the like, and some cases in which desired control cannot be performed are also assumed. Therefore, it is more preferable to implement the sixth embodiment described above with the cloud computing described in the fourth embodiment. The seventh embodiment illustrates a case in which content of processing in such a preferred case is changed, depending on processing speed of the server (cloud computer 500) and the client (device 400), throughput of the client.

Figures 22, 23:
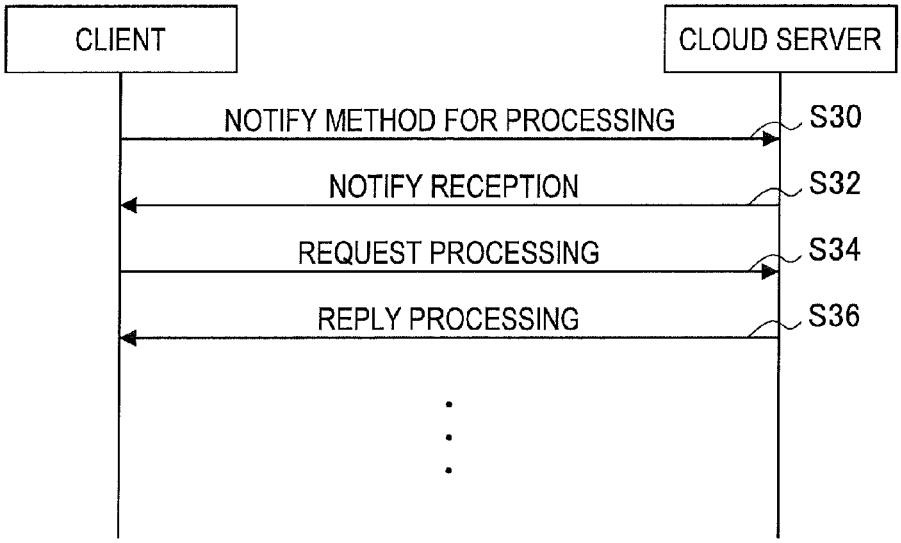
FIG. 22 is a sequence diagram showing an example of communications between a cloud computer and a device.
FIG. 23 is a schematic view showing a type of metadata transmitted from the cloud computer to the device, a transmission band and an advantage of load on the device.

FIG. 22 is a sequence diagram showing an example of communications between the cloud computer 500 and the device 400. First, in step S30, the device 400 notifies the cloud computer 500 of a method for processing. More specifically, the device 400 notifies the cloud computer 500 of what information the device 400 transmits to the cloud computer 500 and what information the cloud computer 500 sends back to the device 400, depending on circumstances such as specifications of the CPU (processing speed, power), capacity of a memory, or a transmission rate. In step S32, in response to the notification from the device 400, the cloud computer 500 notifies the device 400 that the cloud computer 500 has received the notification.

In the next step S34, the device 400 transmits a request for processing to the cloud computer 500. Now, the device 400 transmits sound data and information such as a viewer position, a sound source position, virtual sound source position information and the like to the cloud computer 500, requesting the cloud computer to perform processing.

The cloud computer 500 performs the processing according to the method for processing notified by the device 400 in step S30. In the next step S36, the cloud computer 500 transmits a reply to the request for processing to the device 400. In step S36, the cloud computer 500 sends back to the device 400 sound data after processing, or a reply on a factor necessary for the processing and the like.

For example, when a transmission rate with the cloud computer 500 is relatively fast although CPU capacity of the device 400 is insufficient, in step S34, the device 400 transmits metadata such as sound data, the viewer position, the sound source position, a virtual sound source position and the like to the cloud computer 500. Then, the device 400 requests the cloud computer 500 to select an appropriate HRTF from a volume of database, perform the virtual sound source reproduction processing, and return sound data after processing to the device 400. In step S36, the cloud computer 500 transmits the sound data after processing to the device 400. This enables higher precision, rich sound source processing with low CPU capacity in the device 400.

On the one hand, if the CPU capacity of the device 400 is sufficient, in step S34, the device 400 transmits the position information or only a difference thereof to the cloud computer 500. Then, in response to the request from the device 400, in step S36, the cloud computer 500 sends back to the device 400 the appropriate factor such as an HRTF and the like from the volume of database, and the virtual sound source reproduction processing is performed on the side of the client. In addition, the device 400 can make a faster response by preloading to the cloud computer 500 supplementary data for predicting position information such as HRTF data in the neighborhood of the position information or information on a difference of position information transmitted previously, rather than transmitting the position information itself such as a current viewer position, sound source position or virtual sound source position and the like in step S34.

FIG. 23 is a schematic view showing a type of metadata to be transmitted from the cloud computer 500 to the device 400, transmission bands and advantages of loads on the device 400. The example shown in FIG. 23 lists the transmission band and the advantages of CPU load of the device 400 for the following three cases in which as meta data: (1) an amount of characteristic of a head transfer function HRTF (or a virtual sound source reproduction correction factor) is transmitted, (2) a HRTF is transmitted, and (3) information of an HRTF in which a sound source is convolved is transmitted.

In the case in which (1) an amount of characteristic of a HRTF is transmitted, rather than the cloud computer 500 sequentially transmitting to the device 400 a HRTF computed from position information and the like, a HRTF is transmitted once, and subsequently, a difference to the HRTF transmitted last time, an amount of change, is transmitted. With this, a transmission quantity can be minimized after the HRTF is transmitted once, thereby enabling reduction of the transmission band. On the one hand, since the device 400 sequentially computes a HRTF on the basis of the difference and the amount of change, the load on the CPU of the device 400 increases.

In the case in which (2) a HRTF is transmitted, the cloud computer 500 sequentially transmits a HRTF computed from the position information and the like to the device 400. In this case, since the HRTF is transmitted every time, the transmission band becomes larger than the case in (1). On the one hand, since the device 400 can sequentially receive the HRTF itself from the cloud computer 500, the load on the CPU of the device 400 is smaller than the case in (1).

In the case in which (3) information of an HRTF in which a sound source is convolved is transmitted, the cloud computer 500 sequentially transmits to the device 400 information (sound information) of a HRTF computed from position information and the like into which a sound source is further convolved. Specifically, the cloud computer 500 performs processing to the sound control unit 106 of the sound field control device 100. In this case, since an amount of information to be transmitted from the cloud computer 500 to the device 400 increases, the transmission band is larger than (1) and (2). On the one hand, since the device 400 can output sound by directly using the received information, the load on the CPU of the device 400 is smallest.

Information on which processing in (1) to (3) is performed is included in the notification of the method for processing that the device 400 transmits in step S30 of FIG. 22. A user can specify which processing in (1) to (3) to perform, by operating the device 400. In addition, the device 400 or the cloud computer 500 may automatically determine which processing in (1) to (3) is performed, depending on the transmission band or the CPU capacity of the device 400.

Figure 24:
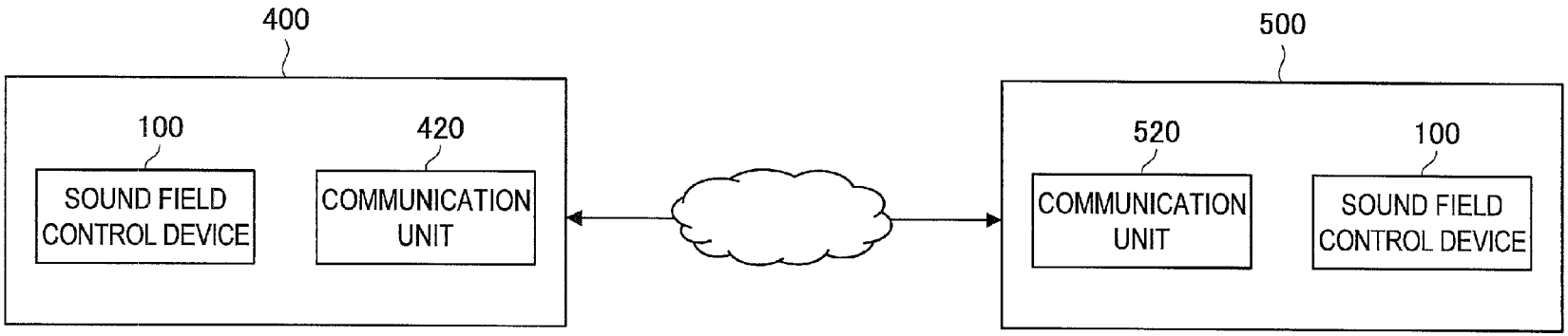
FIG. 24 is a schematic view showing a configuration of the device and the cloud computer.

FIG. 24 is a schematic view showing a configuration of the device 400 and the cloud computer 500. The device 400 has a communication unit 420 for communicating with the cloud computer 500 via a network, in addition to the configuration of the sound field control device 100 in FIG. 1. In addition, the cloud computer 500 has a communication unit 520 for communicating with the device 400 via a network, in addition to the configuration of the sound field control device 100 in FIG. 1. Then, as described above, processing of the sound field control device 100 is distributed to the device 400 and the cloud computer 500, depending on the transmission band and the CPU load of the device 400. In addition, the sound field control device 100 of the cloud computer 500 may not include an imaging unit 102. In addition, in each of the device 400 and the cloud computer 500, the sound field control device 100 may include the communication unit 420 or the communication unit 520.

Figure 25:
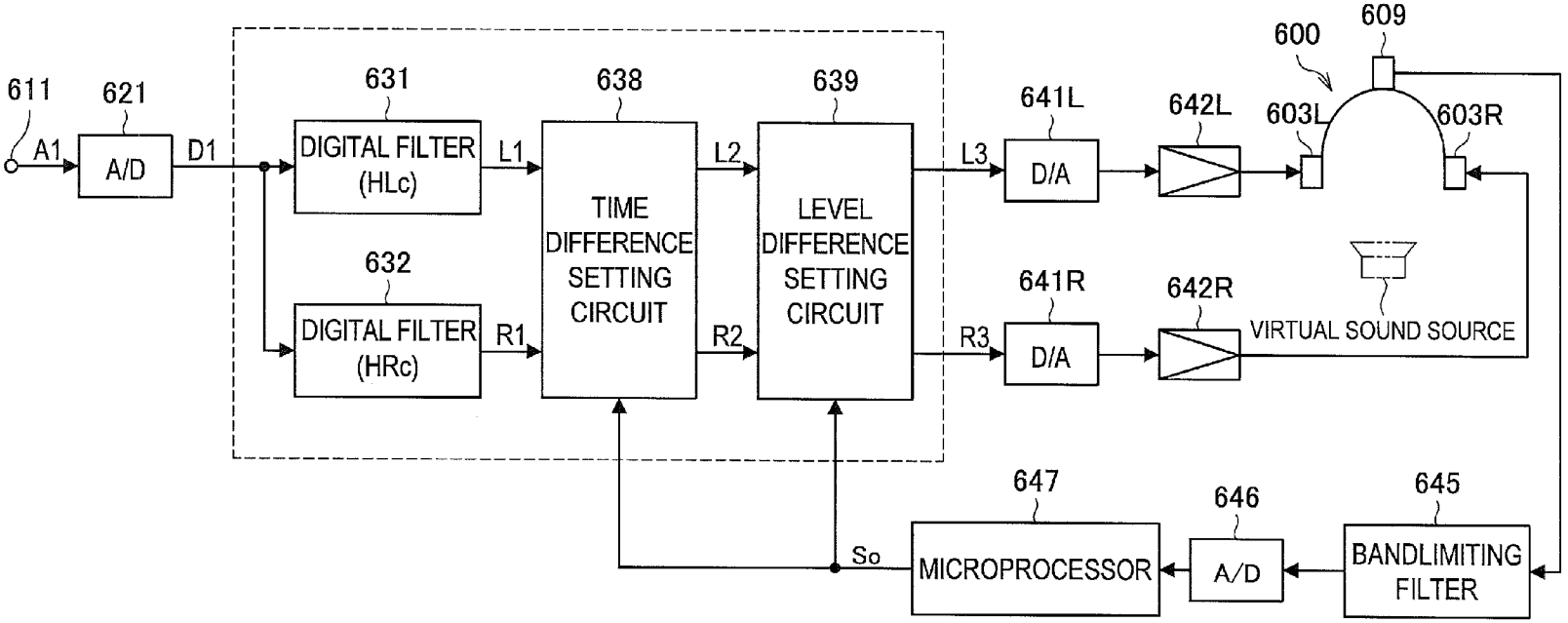
FIG. 25 is a schematic view showing one example of a system including a head tracking headphone.

In the following, a case in which the sound field control device 100 is a head tracking headphone will be described. FIG. 25 is a schematic view showing one example of a system including a head tracking headphone 600. A basic configuration of this system is similar to the system described in JP 2003-111197A, and an overview of the system will be described below. An angular velocity sensor 609 is provided in the headphone 600. An output signal of the angular velocity sensor 9 is band-limited by a bandlimiting filter 645, further converted into digital data by an A/D (Analog to Digital) converter 646, captured into a microprocessor 647, and integrated by the microprocessor 647 to detect a rotation angle (orientation) θ of a head of a listener wearing the headphone 600.

An input analog sound signal Ai, which is supplied to a terminal 611 and corresponds to a signal of a sound source 605, is converted to a digital sound signal Di by an A/D converter 621, and the digital sound signal Di is supplied to a signal processing unit 630.

As a unit including software (processing program) by a dedicated DSP (Digital Signal Processor) and the like or a hardware circuit, the signal processing unit 630 functionally consist of digital filters 631, 632, a time difference setting circuit 638, and a level difference setting circuit 639, and supplies the digital sound signal Di from the A/D converter 621 to the digital filers 631 and 632.

The digital filters 631 and 632 convolve impulse responses which correspond to transfer functions HLc and HRc reaching a left ear 1L and a right ear 1R of a listener 1 from the sound source 605, and consist of FIR filters, for example.

Specifically, in the digital filters 631 and 632, respectively, a sound signal supplied to input terminals is sequentially delayed by cascade-connected delay circuits for a delay time having a sampling period τ thereof, the sound signal supplied to the input terminals and the output signal of each delay circuit are multiplied by a factor of an impulse response in each multiplication circuit, the output signal of each multiplication circuit is sequentially added in each adder circuit, and the sound signal after filtering is obtained at the output terminal.

Sound signals L1 and R1 which are outputs of these digital filters 631 and 632 are supplied to the time difference setting circuit 638, and sound signals L2 and R2 which are outputs of the time difference setting circuit 638 are supplied to the level difference setting circuit 639. Sound signals L3 and R3 which are outputs of the level difference setting circuit 639 are D/A converted by D/A converters 641R, 641L and supplied to speakers 603R, 603L by way of elements 642R, 642L.

In the configuration described above, orientation of a face of the user wearing the headphone 600 can be detected from information obtained from a gyro sensor that the headphone is equipped with. This enables a virtual sound source position to be controlled, depending on the orientation of the headphone 600. For example, control can be performed so that the virtual sound source position does not change when the orientation of the headphone 600 changes. With this, the user wearing the headphone 600 can recognize that sound is generated from a same position even if the face of the user turns, which thus can enhance a sense of reality. In addition, the configuration for controlling the virtual sound source position on the basis of the information obtained from the gyro sensor can be made similar to the third embodiment.

(8. Eighth Embodiment)

In the following, an eighth embodiment of the present disclosure will be described. In the eighth embodiment, when a sound field control device 100 is incorporated in a small device such as a smart phone, a virtual sound source is reproduced through the use of a ultrasonic speaker. In the small device such as the smart phone, since spacing between right and left speakers is narrow, it is difficult to cancel crosstalk in which right and left sounds are mixed. In such a case, use of the ultrasonic speaker in the small device such as the smart phone enables cancellation of the crosstalk.

(9. Ninth Embodiment)

Figure 26:
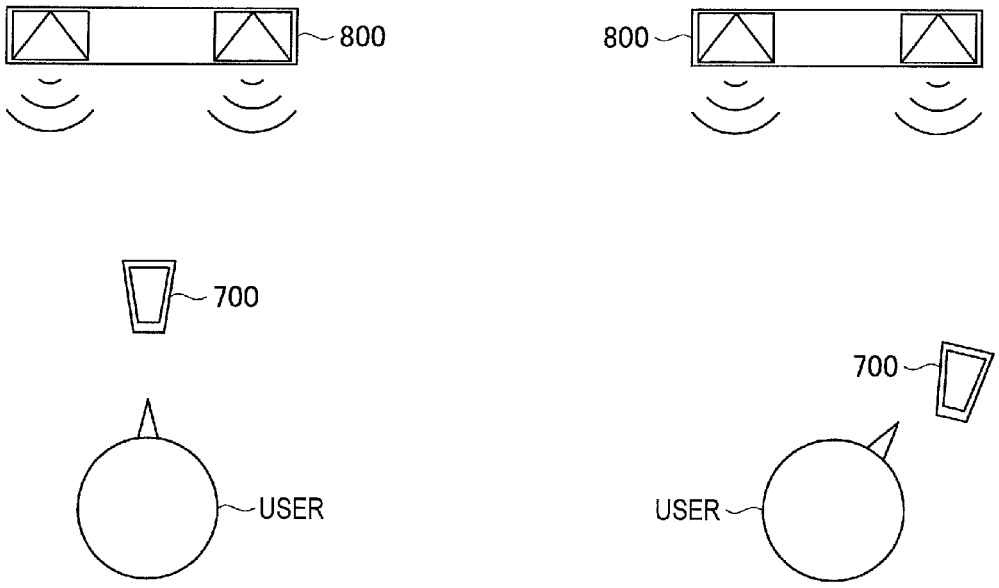
FIG. 26 is a schematic view showing an overview of a ninth embodiment.

In the following, a ninth embodiment of the present disclosure will be described. The ninth embodiment describes a case in which a sound source is configured in a device separate from a device for sensing a viewer's position or orientation such as a camera or an ultrasonic sensor, a gyro sensor and the like. FIG. 26 is a schematic view showing an overview of the ninth embodiment. As shown in FIG. 26, suppose that a user holds a device 700 for sensing a position or posture, such as a smart phone, a tablet and the like, when the user is listening to a sound generated from external speakers 800. As shown in FIG. 26, when the user turns while holding the device 700, a positional relationship between a camera (imaging unit) that the device 700 is equipped with and the user does not change. However, a positional relationship between the user and the external speakers 800 changes. Thus, any change in an absolute position or direction of the user is estimated through the use of the gyro sensor and the like that the device 700 is equipped with.

Figure 27:
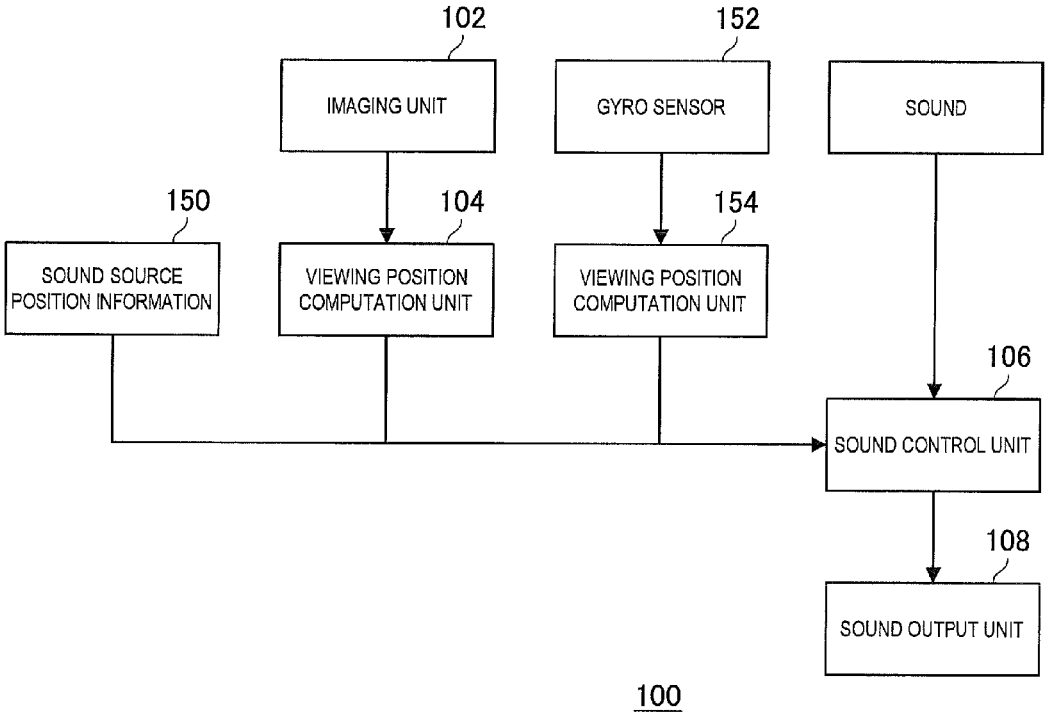
FIG. 27 is a schematic view showing a configuration of a sound field control unit of the ninth embodiment.

FIG. 27 is a schematic view showing a configuration of the sound field control unit 100 of the ninth embodiment. In the ninth embodiment, the device 700 is equipped with the sound field control device 100. As shown in FIG. 27, the sound field control device 100 of the ninth embodiment is configured to have a sound source position information acquisition unit 150, a gyro sensor 152, and a viewing position computation unit 154, in addition to the configuration of FIG. 1. The sound source position information acquisition unit 150 acquires a position of the external speaker 800 with respect to the device 700. The viewing position computation unit 154 computes the user's absolute position and direction on the basis of a detected value of the gyro sensor. A sound control unit 106 controls the virtual sound source position on the basis of information acquired by the sound source position information acquisition unit and information computed by the viewing position computation unit 154. This enables the virtual sound source position to be controlled based on the user's absolute position and direction.

The preferred embodiments of the present disclosure have been described above with reference to the accompanying drawings, whilst the technical scope of the present disclosure is not limited to the above examples, of course. A person skilled in the art may find various alterations and modifications within the scope of the appended claims, and it should be understood that they will naturally come under the technical scope of the present invention.

Additionally, the present technology may also be configured as below.

(1) A sound field control device including:

a display target object position information acquisition unit for acquiring position information of a display target object corresponding to a sound source; and a virtual sound source position control unit for controlling a virtual sound source position on the basis of position information of the display target object.

(2) The sound field control device according to (1), further including:

a transmission unit for transmitting, to an external computer, at least the position information of the display target object; and a reception unit for receiving, from the external computer, a virtual sound source reproduction correction factor computed on the basis of the position information of the display target object or information generated on the basis of the virtual sound source reproduction correction factor.

(3) The sound field control device according to (2), wherein the transmission unit transmits, to the external computer, sound data together with the position information of the display target object, and wherein the reception unit receives, from the external computer, sound data that is obtained by correcting the sound data with the virtual sound source reproduction correction factor computed on the basis of the position information of the display target object.

(4) The sound field control device according to (1), further including:

a viewer position information acquisition unit for acquiring position information of a viewer, wherein the virtual sound source position control unit controls the virtual sound source position on the basis of the position information of the display target object and the position information of the viewer.

(5) The sound field control device according to (4), wherein the viewer position information acquisition unit acquires the position information of the viewer from information obtained by imaging.

(6) The sound field control device according to (4), further including:

a transmission unit for transmitting, to the external computer, the position information of the display target object and the position information of the viewer; and a reception unit for receiving, from the external computer, a virtual sound source reproduction correction factor computed on the basis of the position information of the display target object and the position information of the viewer or information generated on the basis of the virtual sound source reproduction correction factor.

(7) The sound field control device according to (6), wherein the transmission unit transmits, to the external computer, sound data together with the position information of the display target object and the position information of the viewer, and wherein the reception unit receives, from the external computer, sound data which is obtained by correcting the sound data with the virtual sound source reproduction correction factor computed on the basis of the position information of the display target object and the position information of the viewer.

(8) A sound field control device including:

acquiring position information of a display target object corresponding to a sound source; and controlling a virtual sound source position on the basis of the position information of the display target object.

(9) A program for causing a computer to function as:

means for acquiring position information of a display target object corresponding to a sound source; and means for controlling a virtual sound source position on the basis of the position information of the display target object.

(10) A sound field control system including:

a client terminal including a display target object position information acquisition unit for acquiring position information of a display target object corresponding to a sound source, a transmission unit for transmitting the position information of the target object to an external computer, and a reception unit for receiving, from the external computer, a virtual sound source reproduction correction factor computed on the basis of the position information of the target object; and the external computer including a reception unit for receiving the position information of the display target object, a virtual sound source reproduction correction factor computation unit for computing the virtual sound source reproduction correction factor on the basis of the position information of the display target object, and a transmission unit for transmitting, to the client terminal, the virtual sound source reproduction correction factor or information generated on the basis of the virtual sound source reproduction correction factor.

(11) A server including the external computer including a reception unit for receiving, from a client terminal, position information of a display target object corresponding to a sound source;

a virtual sound source reproduction correction factor computation unit for computing the virtual sound source reproduction correction factor on the basis of the position information of the display target object; and a transmission unit for transmitting, to the client terminal, the virtual sound source reproduction correction factor or information generated on the basis of the virtual sound source reproduction correction factor.

(12) A sound field control method including:

acquiring, by a client terminal, position information of a display target object corresponding to a sound source;

transmitting, by the client terminal, the position information of the target object to an external computer;

receiving, by the external computer, the position information of the display target object;

computing, by the external computer, the virtual sound source reproduction correction factor on the basis of the position information of the display target object; and transmitting, by the external computer, to the client terminal, the virtual sound source reproduction correction factor or information generated on the basis of the virtual sound source reproduction correction factor.

(13) A sound field control device including:

a position information acquisition unit for acquiring position information of a viewer from information obtained by imaging; and a virtual sound source position control unit for controlling a virtual sound source position on the basis of the position information.

(14) The sound field control device according to (13), wherein the virtual sound source position control unit controls the virtual sound source position in a manner that a normal position of a sound image is fixed irrespective of a position of the viewer.

(15) The sound field control device according to (13), wherein the virtual sound source position control unit controls the virtual sound source position in a manner that a normal position of a sound image relatively moves according to a position of the viewer.

(16) The sound field control device according to (13), wherein the virtual sound source position control unit controls the virtual sound source position by changing a head transfer function, on the basis of the position information.

(17) The sound field control device according to (13), wherein the virtual sound source position control unit controls the virtual sound source position, on the basis of the position information, by smoothly changing a factor before a position of the viewer changes to a factor after the position of the viewer changes.

(18) The sound field control device according to (13), wherein the virtual sound source position control unit controls the virtual sound source position, on the basis of the position information, when movement of the viewer exceeds a predetermined value.

(19) The sound field control device according to (13), further including:

a control unit for controlling sound volume, a delay amount of sound, or a directional characteristic, on the basis of the position information.

(20) The sound field control device according to (13), including:

an imaging unit for acquiring the position information of the viewer.

(21) The sound field control device according to (13), including:

a posture information acquisition unit for acquiring posture information, wherein the virtual sound source position control unit controls the virtual sound source position, on the basis of the position information and the posture information.

(22) The sound field control device according to (13), wherein the position information acquisition unit acquires, from another device including an imaging unit for imaging the viewer, information obtained by the imaging.

(23) A sound field control method including:

acquiring position information of a viewer; and controlling a virtual sound source position on the basis of the position information.

(24) A program for causing a computer to function as:

means for acquiring position information of a viewer; and means for controlling a virtual sound source position on the basis of the position information.

(25) A sound field control system including:

an imaging device for imaging a viewer; and a sound field control device including a position information acquisition unit for acquiring position information of the viewer from information obtained from the imaging device, and a virtual sound source position control unit for controlling a virtual sound source position on the basis of the position information.

REFERENCE SIGNS LIST

100 sound field control device
102 imaging unit
106 sound control unit
120 virtual sound source reproduction correction unit
130 virtual sound source reproduction correction/change unit
400 device (client terminal)
500 cloud computer (server)

The invention claimed is:

1. A sound field control device comprising:

circuitry configured to acquire position information of a display target object corresponding to a sound source;

control a virtual sound source position on the basis of position information of the display target object;

transmit, to an external computer, at least the position information of the display target object; and receive, from the external computer, a virtual sound source reproduction correction factor computed on the basis of the position information of the display target object or information generated on the basis of the virtual sound source reproduction correction factor.

2. The sound field control device according to claim 1, wherein the circuitry is further configured to transmit, to the external computer, sound data together with the position information of the display target object, and receive, from the external computer, sound data that is obtained by correcting the sound data with the virtual sound source reproduction correction factor computed on the basis of the position information of the display target object.

3. A sound field control device comprising:

circuitry configured to acquire position information of a display target object corresponding to a sound source;

control a virtual sound source position on the basis of position information of the display target object;

transmit, to an external computer, at least the position information of the display target object;

receive, from the external computer, a virtual sound source reproduction correction factor computed on the basis of the position information of the display target object or information generated on the basis of the virtual sound source reproduction correction factor;

acquire position information of a viewer from information obtained by imaging; and control the virtual sound source position on the basis of the position information of the display target object and the position information of the viewer.

4. A sound field control device comprising:

circuitry configured to acquire position information of a display target object corresponding to a sound source;

control a virtual sound source position on the basis of position information of the display target object;

acquire position information of a viewer;

transmit, to an external computer, at least the position information of the display target object and the position information of the viewer;

receive, from the external computer, a virtual sound source reproduction correction factor computed on the basis of the position information of the display target object and the position information of the viewer or information generated on the basis of the virtual sound source reproduction correction factor; and control the virtual sound source position on the basis of the position information of the display target object and the position information of the viewer.

5. The sound field control device according to claim 4, wherein the circuitry is further configured to transmit, to the external computer, sound data together with the position information of the display target object and the position information of the viewer, and receive, from the external computer, sound data which is obtained by correcting the sound data with the virtual sound source reproduction correction factor computed on the basis of the position information of the display target object and the position information of the viewer.

6. A sound field control method comprising:

acquiring position information of a display target object corresponding to a sound source;

controlling a virtual sound source position on the basis of the position information of the display target object;

transmitting, to an external computer, at least the position information of the display target object; and receiving, from the external computer, a virtual sound source reproduction correction factor computed on the basis of the position information of the display target object or information generated on the basis of the virtual sound source reproduction correction factor.

7. A non-transitory, computer-readable storage medium storing computer-executable instructions that, when executed on a computer, control the computer to acquire position information of a display target object corresponding to a sound source;

control a virtual sound source position on the basis of the position information of the display target object;

transmit, to an external computer, at least the position information of the display target object; and receive, from the external computer, a virtual sound source reproduction correction factor computed on the basis of the position information of the display target object or information generated on the basis of the virtual sound source reproduction correction factor.

* * * * *